US008043780B2

(12) United States Patent
Sugiura et al.

(10) Patent No.: US 8,043,780 B2
(45) **Date of Patent: *Oct. 25, 2011**

(54) TONER, AND DEVELOPER, DEVELOPING APPARATUS, PROCESS CARTRIDGE, IMAGE FORMING APPARATUS AND IMAGE FORMING METHOD

(75) Inventors: Hideki Sugiura, Fuji (JP); Shinya Nakayama, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 243 days.

This patent is subject to a terminal disclaimer.

(21) Appl. No.: 11/813,712

(22) PCT Filed: Dec. 26, 2005

(86) PCT No.: PCT/JP2005/024210

§ 371 (c)(1),
(2), (4) Date: Jul. 11, 2007

(87) PCT Pub. No.: WO2006/075534

PCT Pub. Date: Jul. 20, 2006

(65) Prior Publication Data

US 2008/0305423 A1 Dec. 11, 2008

(30) Foreign Application Priority Data

Jan. 11, 2005 (JP) ..... 2005-004533

(51) Int. Cl.
*G03G 9/08* (2006.01)

(52) U.S. Cl. ..... 430/110.3; 430/109.4; 430/110.4; 430/111.4; 399/252

(58) Field of Classification Search ..... 430/109.4, 430/110.3, 110.4, 111.4; 399/252
See application file for complete search history.

(56) References Cited

U.S. PATENT DOCUMENTS

| | | | | |
|---|---|---|---|---|
| 6,607,864 | B2 * | 8/2003 | Serizawa et al. | 430/123.52 |
| 6,746,809 | B1 * | 6/2004 | Sato et al. | 430/110.2 |
| 7,005,223 | B2 * | 2/2006 | Yamashita et al. | 430/108.3 |
| 7,157,201 | B2 * | 1/2007 | Tomita et al. | 430/109.4 |
| 7,303,847 | B2 * | 12/2007 | Tomita et al. | 430/108.9 |
| 7,374,848 | B2 * | 5/2008 | Matsuoka et al. | 430/109.4 |
| 7,384,720 | B2 * | 6/2008 | Tomita et al. | 430/108.4 |
| 7,531,281 | B2 * | 5/2009 | Tomita et al. | 430/110.4 |
| 2002/0055055 | A1 * | 5/2002 | Nakamura et al. | 430/137.17 |
| 2003/0077536 | A1 * | 4/2003 | Yamashita et al. | 430/110.3 |
| 2003/0096185 | A1 * | 5/2003 | Yamashita et al. | 430/109.4 |

(Continued)

FOREIGN PATENT DOCUMENTS

EP 0 628 883 * 12/1994

(Continued)

OTHER PUBLICATIONS

Abstract of JP 02022668, Jan. 1990.*

(Continued)

*Primary Examiner* — Hoa Le
(74) *Attorney, Agent, or Firm* — Oblon, Spivak, McClelland, Maier & Neustadt, L.L.P.

(57) ABSTRACT

A toner that includes toner base particles including a binder resin and a colorant, wherein the toner base particles have a surface roughness (Ra) of 18 nm to 50 nm and a standard deviation (RMS) of the surface roughness of 0.5 nm to 9.9 nm. A developer, a developing apparatus, a process cartridge, an image forming apparatus, and an image forming method can all use a developer including the toner.

15 Claims, 9 Drawing Sheets

U.S. PATENT DOCUMENTS

| | | | | |
|---|---|---|---|---|
| 2003/0134220 | A1* | 7/2003 | Emoto et al. | 430/109.4 |
| 2003/0138717 | A1* | 7/2003 | Yagi et al. | 430/110.4 |
| 2003/0152859 | A1* | 8/2003 | Emoto et al. | 430/109.4 |
| 2003/0162112 | A1 | 8/2003 | Yamashita et al. | |
| 2004/0053154 | A1* | 3/2004 | Tomita et al. | 430/109.4 |
| 2004/0142268 | A1* | 7/2004 | Yamanouchi et al. | 430/111.4 |
| 2004/0146795 | A1* | 7/2004 | Emoto et al. | 430/109.4 |
| 2004/0191659 | A1* | 9/2004 | Nakamura et al. | 430/108.8 |
| 2005/0191575 | A1 | 9/2005 | Sugiura et al. | |
| 2005/0277045 | A1* | 12/2005 | Saito et al. | 430/109.3 |
| 2006/0172217 | A1* | 8/2006 | Kidokoro | 430/110.3 |
| 2006/0204883 | A1* | 9/2006 | Nakayama et al. | 430/111.4 |

FOREIGN PATENT DOCUMENTS

| | | | |
|---|---|---|---|
| EP | 1 439 429 | A1 | 7/2004 |
| EP | 1 615 080 | A1 | 1/2006 |
| JP | 02022668 | * | 1/1990 |
| JP | 9 179331 | | 7/1997 |
| JP | 10 142835 | | 5/1998 |
| JP | 11 327197 | | 11/1999 |
| JP | 2001 51444 | | 2/2001 |
| JP | 2004 198658 | | 7/2004 |
| JP | 2004 246344 | | 9/2004 |
| JP | 2004 310018 | | 11/2004 |
| WO | WO 2004/086149 | A1 | 10/2004 |

OTHER PUBLICATIONS

U.S. Appl. No. 12/048,741, filed Mar. 14, 2008, Moriya, et al.

Supplementary European Search Report issued Sep. 29, 2010, in Patent Application No. 05851010.8.

* cited by examiner

TONER, AND DEVELOPER, DEVELOPING APPARATUS, PROCESS CARTRIDGE, IMAGE FORMING APPARATUS AND IMAGE FORMING METHOD

TECHNICAL FIELD

The present invention relates to a toner used for image formation by an electrostatic copying process such as copying machine, facsimile and printer, as well as a developer comprising the toner, a developing apparatus, a process cartridge, an image forming apparatus and an image forming method using the developer.

BACKGROUND ART

An image forming method by electrographic process generally comprises: a charging process of charging by electric discharge the surface of a photoconductor which is an image bearing member; an exposing process of forming a latent electrostatic image by exposing the charged photoconductor surface; a developing process of developing a toner image by supplying a toner to the latent electrostatic image formed on the photoconductor surface; a transferring process of transferring the toner image on the photoconductor surface onto the surface of a transferring member; a fixing process of fixing the toner image on the surface of the transferring member; and a cleaning process of removing the toner left on the surface of the image bearing member after the transferring process.

Recently, in association with the broad propagation of color image forming apparatuses using the electrographic process and easily available digitized images, it is desired to make an image to be printed with higher definition. While higher resolution and gradation of images are being examined, regarding the improvement of a toner which visualizes a latent image, it has been studied to further ensphere the toner and reduce the particle size in order to form an image with high definition. Since the toners produced by pulverizing methods have limited properties thereof, polymerized toners produced by a suspension polymerization method, an emulsification polymerization method and a dispersion polymerization method capable of ensphering the particles and reducing the particle size are being employed.

A toner with high sphericity is easily affected by electric lines of force in an electrostatic development method, and a toner image is closely developed along the electric lines of force of the latent electrostatic image on the photoconductor. The toner is easily arranged densely and uniformly, and the reproducibility a thin line becomes high when a latent image of fine dots is reproduced. In addition, since the toner has high particulate flowability due to its smooth surface and small adhesive strength among the toner particles or between the toner particles and the photoconductor; Therefore, the electrostatic transferring method has high transfer ability since the toner is easily affected by the electric lines of force, and the transfer is easily performed faithfully along the electric lines of force.

However, the toner with high degree of sphericity has a smaller surface area compared to an amorphous toner of the same particle diameter. This means that the surface available for frictional charge by contact with a frictional charging member such as a magnetic carrier and developer regulation member is small. When the toner is spherical, it easily slides on the surface of the above frictional charging member. Thus, the charging speed and the charging level are low. Therefore, more than a certain amount of a charge controller is required on the surface of the toner.

Additionally, the smaller the toner particle diameter is for enhancing the reproducibility of a fine dot, the more the frictional charge property is reduced. Thus, it is a critical issue to simultaneously satisfy the charge property, developing property and transfer property.

Regarding the spherical toner and the toner having a small particle diameter, various proposals to control their shapes have been made. Shape Factors SF-1 and SF-2 are often used as indicators representing the toner shape. The shape factor SF-1 is an indicator that represents the degree of roundness of a toner particle, and SF-2 is an indicator that represents the degree of convexoconcave of a toner particle. For example, Patent Literatures 1 to 3 attempt to control the shape of the particles by defining the ranges of the shape factors SF-1 and/or SF-2 in order to simultaneously satisfy the charge property, developing property, transfer property, or cleaning property even with a spherical toner and a toner having small particle diameter.

Patent Literature 4 describes a technology which defines the range of the shape factor of toner particles as well as a surface area ratio represented by the following formula:

$$\text{Surface area ratio}=\rho\times D50p\times S$$

where ρ is a specific gravity (g/cm$^3$) of the toner particles, D50p is a number average particle diameter (m) of the toner particles, and S is BET specific surface area (m$^2$/g) of the toner particles.

This surface area ratio is a different measure that represents the degree of convexoconcave of the toner particle from the foregoing shape factor. When the value of the surface area ratio exceeds a given range, the degree of convexoconcave on the surface of the toner particle becomes large. This allows an external additive added externally with time to the toner particles to enter in the depressing portions of the toner particles, and thus it becomes impossible to maintain the charge property and the transfer property over a long period of time.

In Patent Literature 5, the toner surface is defined by an atomic force microscope. However, the degree of convexoconcave in Patent Literature 5, i.e., the degree of surface roughness (Ra), the degree of standard deviation of Ra (RSM) and the number of projective portions having difference of elevation of 20 nm or more, is not sufficient for a cleaning system with higher durability and stability. It was desired that more enhanced cleaning property, by further increasing the degree of convexoconcave in the toner shape reduced cleaning blade abrasion and hence improved the image stability in printing with time.

The technology described in Patent Literature 5 is characterized by having a fine convexoconcave on the toner surface for the purpose of particularly improving the charge property, developing property and transfer property. However, the irregular shape property (large convexoconcave) of the toner as a whole is not sufficient since fine particles such as organosilica are not suitably used for changing the shape. Therefore, it was absolutely insufficient for solving a problem of an stability of the cleaning over time.

As described above, despite many attempts to enhance the charge property, developing property, transfer property or cleaning property by controlling the shapes of the toner particles, a toner having sufficiently satisfactory performance and the related technology have not yet been provided because all the attempts only have a rough view of the surface shape of the toner particle, and none of them grasps the microscopic state of concavoconvex for simultaneously satisfying the charge property, developing property, transfer property and cleaning stability with time.

| | |
|---|---|
| Patent Literature 1 | Japanese Patent Application Laid-Open (JP-A) No. H09-179331 |
| Patent Literature 2 | JP-A No. H10-142835 |
| Patent Literature 3 | JP-A No. H11-327197 |
| Patent Literature 4 | JP-A No. 2001-51444 |
| Patent Literature 5 | JP-A No. 2004-246344 |

DISCLOSURE OF INVENTION

The present invention aims at providing a toner capable of simultaneously satisfying a charge property, a developing property, a transfer property and a cleaning stability over time even in the spherical shape or with a small particle diameter by controlling the degree of the microscopic concavoconvex on the surface of toner base particles, as well as a developer, a developing apparatus, a process cartridge, an image forming apparatus and an image forming method using the developer.

The toner of the present invention comprises toner base particles comprising a binder resin and a colorant, wherein the toner base particles has a surface roughness (Ra) of 18 nm to 50 nm and a standard deviation (RMS) of the surface roughness of 0.5 nm to 9.9 nm.

In the present invention, the following are preferable: an aspect where the surface roughness (Rz) of the toner base particles is 30 nm to 200 nm; an aspect where inorganic particulates are contained inside the toner base particles; an aspect where an average circularity of the toner base particles is 0.93 to 1.00; an aspect where a volume average particle diameter (Dv) of the toner base particles is 2.0 μm to 6.0 μm and a ratio (Dv/Dn) thereof to a number average particle diameter (Dn) is 1.00 to 1.40; an aspect where a ratio Ra (nm)/Dv (μm) of the surface roughness (Ra) to the volume average particle diameter (Dv) is 0.3 to 17.0; an aspect where a shape factor SF-2 of the toner base particles is 100 to 140 and a ratio (Ra/SF-2) of the surface roughness (Ra) to the shape factor SF-2 is 0.008 to 0.500; an aspect where the toner is obtained by being granulated in a liquid medium; an aspect where the surface of the toner base particles has a different resin from the binder resin; an aspect where a releasing agent is contained in the toner base particles; an aspect where a dissolution or a dispersion in which a toner material comprising inorganic particulates has been dissolved or dispersed in an organic solvent is granulated in an aqueous medium followed by removing the organic solvent; an aspect where the toner is obtained by dissolving or dispersing a toner material comprising a polyester prepolymer having a functional group comprising a nitrogen atom, a polyester resin, a colorant and a releasing agent in an organic solvent, subsequently dispersing a dissolution or a dispersion in an aqueous medium and performing at least either one of a crosslinking reaction or an extension reaction, and the like.

The developer of the present invention comprises the above toner of the present invention. The developer of the present invention preferably has an aspect of either one-component developer or two-component developer.

In the developing apparatus of the present invention, the developer is borne and delivered by a latent image bearing member, an alternating electric field is applied at a position opposite to the latent image bearing member, and a latent electrostatic image is developed on the latent image bearing member; the above developer is the developer of the present invention.

The process cartridge of the present invention comprises a latent image bearing member and a developing unit configured to develop the latent electrostatic image formed on the latent image bearing member using the developer of the present invention to form a visible image.

The image forming apparatus of the present invention comprises, in a first embodiment, a latent image bearing member, a latent electrostatic image forming unit configured to form a latent electrostatic image on the latent image bearing member, a developing unit configured to develop the latent electrostatic image using the developer of the present invention to form a visible image, a transferring unit configured to transfer the visible image onto a recording medium, and a fixing unit configured to fix a transfer image transferred onto the recording medium.

The image forming apparatus of the present invention comprises, in a second embodiment, a latent image bearing member, a latent electrostatic image forming unit configured to form a latent electrostatic image is formed on the latent image bearing member, a developing unit configured to develop the latent electrostatic image using the developer to form a visible image, a transferring unit configured to transfer the visible image onto a recording medium and a fixing unit configured to fix a transfer image transferred onto the recording medium; the developing unit is the foregoing developing apparatus of the present invention.

The image forming method of the present invention comprises a latent electrostatic image forming process in which a latent electrostatic image is formed on a latent image bearing member, a developing process in which the latent electrostatic image is developed using the developer of the present invention to form a visible image, a transferring process in which the visible image is transferred onto a recording medium, and a fixing process in which a transfer image transferred onto the recording medium is fixed.

BEST MODES FOR CARRYING OUT THE INVENTION

Toner

Figure 1:
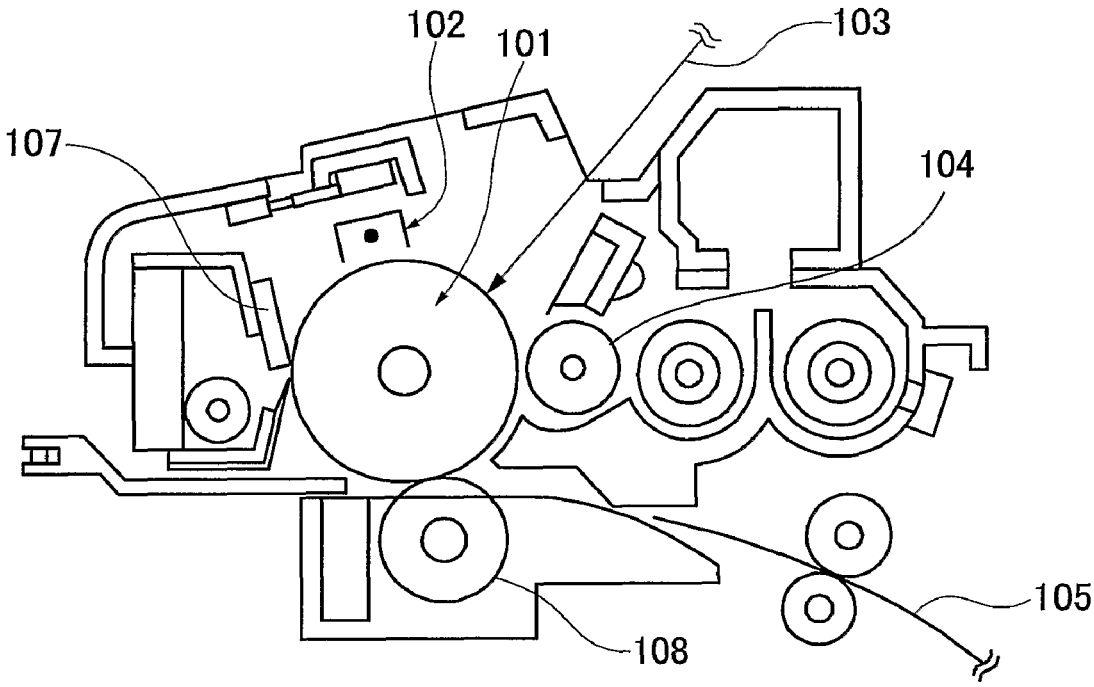
FIG. 1 is a schematic diagram showing one example of a process cartridge of the present invention.

The toner of the present invention comprises toner base particles comprising a binder resin and a colorant, and further contains other ingredients as needed.

A toner base particles has a surface roughness (Ra) of 18 nm to 50 nm and a standard deviation (RMS) of the surface roughness of 0.5 nm to 9.9 nm; the surface roughness Ra is large, and the standard deviation RMS of the surface roughness is small (convexo-concave cycle is short).

Since the toner base particles of conventional toners obtained by suspension polymerization and dissolution suspension are spherical and thus have almost no convexoconcave. Therefore, Ra is reduced (region where RMS is small or large) and is out of the above range. Conventional emulsification aggregation toners have small Ra and large RMS, which are out of this range even if they are modified in shape. Furthermore, conventional toners obtained by pulverization has large Ra and large RMS, which are also out of this range.

Surface characteristics of the toner base particles can be analyzed, for example, using an atomic force microscope (AFM). However, a probe top enters into a concave portion of the concavoconvex when the shape having larger surface concavoconvex is measured, and thus the concavoconvex can not be correctly measured in some cases. Therefore, it is preferable to use a 3D-SEM (3D-scanning electron microscope, field emission electron beam three dimensional roughness analyzer) capable of measuring without contact.

A measurement principle is sometimes different depending on manufacturing corporations, and for example, ERA-8900FE, manufactured by Elionix Co., Ltd., equips multiple, or four, secondary electron detectors with different placement, and it quantitatively detects the amount of secondary electron signals which enter the detector and calculates the angle of gradient for X-Y of a sample. A three dimensional shape can be measured with this apparatus without severe damage to the sample because the shape is evaluated using secondary electron. In addition, a horizontal direction can be measured with high resolution. In the present embodiment, the surface characteristics of the toner base particles were defined by measuring the toner particle surface having 4 μm square.

The surface roughness Ra is defined by a three dimensional average roughness for a center plane (i.e., the plane which divides the concavo-convex volume equally in above and below this plane) and is represented by the following formula I:

$$R_a = \frac{\sum_{i=1}^{N} |Z_i - Z_{cp}|}{N} \quad \text{Formula I}$$

where Zcp represents the Z value of the center plane, Zi represents the Z value in each data point, and N represents the number of the data points.

The standard deviation RMS of the surface roughness is the standard deviation of Z values of all data points and is represented by the following formula II:

$$\text{RMS} = \sqrt{\frac{\sum_{i=1}^{N} (Z_i - Z_{ave})^2}{N}} \quad \text{Formula II}$$

where Zave represents the mean of all Z values, Zi represents the Z value of each data point, and N represents the number of the data points.

The surface roughness (Ra) is defined by an average length of the highest 5 points from peaks and the lowest 5 points from bottoms selected for each reference length.

The surface roughness (Ra) is an average surface roughness and is identical when the volumes of the concavoconvex made by the center plane and the surface shape are equal even whether the particles have a rough concavoconvex or a fine concavoconvex. Meanwhile, the value of the standard deviation (RMS) becomes large when the fine concavoconvex is dominant. Thus, the standard deviation can represent roughness and fineness of the concavoconvex.

Regarding the toner of the present invention, the surface roughness (Ra) of the toner base particles is 18 nm to 50 nm, and more preferably 18 nm to 30 nm. When the surface roughness is less than 18 nm, the concavo-convex size on the surface of the toner base particle is excessively small, a cleaning ability is reduced. A blade wearing property after long use (after printing several hundred thousand sheets), largely contributed by the reduction of the fine cleaning ability, is reduced, which is not preferable. Also, since the frictional charging state is reduced, the charge performance under an environment at high temperature and high humidity or at low temperature and low humidity is reduced, which is not preferable. When the surface roughness (Ra) exceeds 50 nm, the concavo-convex sizes on the surface of the toner base particles are large, which reduces the flowability of the toner as well as the charge property and the transfer property. The sharpness of the image is also reduced.

The standard deviation (RMS) of the surface roughness of the toner base particles is 0.5 nm to 9.9 nm, and preferably 2 nm to 8 nm. In particular, the concavo-convex cycle is very important when the microscopic cleaning ability involved in the cleaning blade wearing property is discussed. A cleaning effect can not be sufficiently exerted when the cycle is excessively large or small. By having a concavo-convex cycle in this range, a dam effect can be formed on the blade with being capable of preventing toner tumble in the cleaning blade while assuring the toner transfer property. A trace amount of the toner scraping through is reduced, and consequently the blade wearing caused by thereof can be prevented. When the standard deviation (RMS) of the surface roughness in the blade is less than 0.5 nm, the surface concavoconvex of the toner base particles becomes excessively rough, and the favorable frictional charging by the contact with the frictional charging member can not be performed. Furthermore, the transfer property as well as the fine cleaning ability is reduced, which increases in the amount of the toner left upon transferring. When RMS exceeds 9.9 nm, the surface concavoconvex of the toner base particles becomes dense, the flowability of the toner is reduced, and a tumble prevention effect of the toner is reduced as well, which consequently reduces the cleaning ability.

The surface roughness (Rz) of the toner base particles is preferably 30 nm to 200 nm, and more preferably 50 nm to 150 nm in terms of cleaning stability and charge stability. The surface roughness (Rz) is an indicator which represents the peak height of a concavoconvex after noise rejection. The larger Rz is, the larger the degree, of concavoconvex is. The smaller Rz is, the smaller the degree of concavoconvex is. When Rz is less than 30 nm, the degree of concavoconvex is excessively small, reducing the cleaning ability as well as the blade wearing property after printing several hundred thousand sheets, which is not preferable. Rz exceeding 200 nm tends not only to impair the toner charge stability but also to cause cracks in the convex portions, which then easily causes the increase of fine powder ingredients in a developing machine after long use for printing, which is not preferable.

The toner of the present invention is toner base particles having the above-mentioned surface characteristics, and it is more preferable that inorganic particulates are internally added to the toner. Internal addition of the inorganic particulates not only enables the formation of the concavoconvex derived from the concavoconvex of the inorganic particulates on the toner surface but also is effective, particularly when the toner produced in a process comprising granulation in a liquid medium, for the following reason. A polymer toner production comprises a desolvation process, where the resin generally shrinks. Meanwhile, hardness around the inorganic particulates is enhanced in particular when the internally added inorganic particulates are present in the vicinity of the surface, which causes a difference in the hardness from that at the portion without organic particulates. Thus, a discrepancy in the shrinking speed occurs, and consequently a deep concavoconvex having a dimple shape is formed on the toner surface.

Regarding the enhancement of the flowability, the charge property and the environmental charge property, it is preferable to externally add the inorganic particulates by combining those of equal or different types.

Examples of the inorganic particulates includes silica, organosilica sol, alumina, titanium oxide, barium titanate, magnesium titanate, calcium titanate, strontium titanate, zinc oxide, tin oxide, quartz sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide and silicon nitride. By using any of them individually or some inorganic particulates in combination, it is possible to enhance the shape, the flowability, developing property and the charge property of the toner base particles.

The primary particle diameter of this inorganic particulate is preferably $5\times10^{-3}$ μm to 2 μm, and more preferably $5\times10^{-3}$ μm to 0.5 μm. It is preferable that the specific surface area by BET method is 20 $m^2/g$ to 500 $m^2/g$. The percentage of this inorganic particulate to be used is preferably 0.01% to 5% by mass, and in particular preferably 0.01% to 2.0% by mass.

It is preferable that an average circularity of the toner base particles is 0.93 to 1.00 in the light of obtaining high image quality because an excellent dot reproducibility and favorable transfer property may be obtained with the above circularity. The toner having such a high average circularity easily slides on the surface of the frictional charging member such as magnetic carrier, and it is disadvantageous in terms of charging speed and charging level. However, by having the surface characteristics of the toner base particle of the present invention, it is possible to obtain a toner with sufficient frictional charge property as well as excellent developing property and transfer property.

When the average circularity is less than 0.93, i.e. the shape of the toner is far from spherical, it is difficult to obtain a sufficient transfer property or a high quality image with no dust. Such amorphous particles have many contact points with medium having a smooth surface such as photoconductor. Also, such particles have larger Van der Waals' force and image force than relatively spherical particles since charges are concentrated at the top of a prominence; hence its adhesive force is also larger. Thus, in a toner where amorphous particles and spherical particles are mixed, the spherical particles selectively move to cause image missing in a text section and a line section in an electrostatic transferring process. The remaining toner must be removed for the subsequent developing process, and there are problems such as a cleaning apparatus is required and that a toner yield (percentage of the toner used for the image formation) is low.

The average circularity of a toner is a value obtained by optically detecting the particles and dividing the circumference of the projection area by the circumference of a circle having the same area as the projection area. Specifically, the particle is measured using a flow mode particle image analyzer (FPIA-2000, manufactured by Sysmex Corporation). In a given vessel, 100 mL to 150 mL of water from which solid impurities have been previously removed is placed. As a dispersant, 0.1 mL to 0.5 mL of a surfactant is added, and about 0.1 g to 9.5 g of a sample to be measured is further added. A suspension in which the sample has been dispersed is treated in an ultrasonic dispersion apparatus for about 1 to 3 minutes to make the concentration of the dispersion 3,000 to 10,000 particles/μL, and the shape and the distribution of the toner are measured.

The toner preferably has a volume average particle diameter (Dv) of 2.0 μm to 6.0 μm and a ratio (Dv/Dn) of the volume average particle diameter (Dv) to a number average particle diameter (Dn) of 1.00 to 1.40. More suitably, the volume average particle diameter is 3.0 μm to 6.0 μm, and Dv/Dn is 1.00 to 1.15. Such a toner has excellent heat resistant storage stability, low-temperature fixing property and hot offset resistance. Especially, an excellent luster property of the image is obtained when used with a full-color copying machine.

In general, the smaller the particle diameter of the toner is, the more advantageous it is for obtaining the image with high resolution and high quality. However, in contrast, it is disadvantageous in terms of the transfer property and the cleaning ability. When the volume average particle diameter is below the range of the present invention, the toner is fused to the surface of the magnetic carrier in a prolonged stirring in the developing apparatus to reduce the charge performance of the magnetic carrier with a two-component developer. In the case of one-component developer, filming of the toner to the developing roller and fusion of the toner to a member such as blade for thin filming of the toner tend to occur.

These phenomena are largely dependent on the content of fine powder. In particular, the content of the particles with a particle diameter of 3 μm or less exceed 10% works against the adhesion to the magnetic carrier and the high-level charge stability.

Conversely, when the volume average particle diameter of the toner is above the range of the present invention, it becomes difficult to obtain an image with high resolution and high quality. In addition, the variation of the particle diameter in the toner often becomes large when the toner in the developer is balanced.

When Dv/Dn exceeds 1.40, a charge distribution becomes wide, and resolution is reduced, which is not preferable.

The average particle diameter and particle size distribution of a toner can be measured using Coulter Counter TA-II or Coulter Multisizer (both are manufactured by Coulter). In the present invention, measurements were performed using Coulter Counter TA-II connected with an interface that output a number distribution and a volume distribution (manufactured by The Institute of Japanese Union of Scientists & Engineers) and with PC9801 personal computer (manufactured by NEC Corporation).

It is also preferable that the ratio of the surface roughness (Ra) to the volume average particle diameter (Dv), i.e. Ra (nm)/Dv (μm), is 0.3 to 10.0. When the above ratio is less than 0.3, the toner base particles easily slide on the surface of the frictional charging member since the degree of concavoconvex is small for the particle diameter of the toner base particle. Therefore, the charge property is reduced, and the cleaning ability is also reduced. Meanwhile, when the above ratio exceeds 10.0, the toner base particles are strongly rubbed with the frictional charging member and easily spent since the degree of concavoconvex is large for the particle diameter of the toner base particle. Thus, the charge performance is reduced.

Preferably, the toner base particles have a shape factor SF-2 of 100 to 140 and the ratio of the surface roughness (Ra) thereto, i.e. Ra (nm)/SF-2, of 0.008 to 0.500.

The shape factor SF-2 indicates the degree of concavoconvex of the toner shape as shown in Formula III below. SF-2 is a value obtained by dividing the square of the peripheral length (PERI) of a shape obtained by projecting the toner to a two dimensional plane by the area (AREA) of the shape, and multiplying 100/4π:

$$SF-2=\frac{(PERI)^2}{\text{AREA}}\times\frac{100}{4\pi}, \qquad \text{Formula III}$$

where PERI represents the peripheral length of the shape obtained by projecting the toner base particle to a two dimensional plane; AREA represents the area of the shape obtained by projecting the toner base particle to the two dimensional plane.

When the value of SF-2 is 100, no macroscopic concavoconvex is present in the toner shape. The larger the value of SF-2 is, the more the concavoconvex in the toner shape becomes remarkable.

The value of SF-2 can be calculated by observing and saving the images of one hundred randomly selected toner particles by a scanning electron microscope (FE-SEM S-4800, manufactured by Hitachi, Ltd.) and by analyzing these images by an image analyzer (LUSEX AP, Nireco Corporation). The analysis is more on the macroscopic concavoconvex of the toner base particle compared to the surface roughness Ra.

When the value of SF-2 exceeds 140, the toner is scattered on the image, and the image quality is reduced. Thus, the value of SF-2 is preferably in the range of 100 to 140.

It is preferable that the ratio of the surface roughness Ra, which represents the fineness of the surface concavoconvex of the toner base particle, to the shape factor SF-2, which represents the macroscopic concavoconvex on the shape of the toner base particle, i.e. Ra (nm)/SF-2, is in the range of 0.008 to 0.500. The toner that has the ratio within this range has suitably fine concavoconvex on the toner base particles, and thus the frictional charge property is favorable. In addition, the toner is excellent in developing property and transfer property since the shape of the toner base particle is nearly spherical, and the image with high quality can be provided.

The toner of the present invention can be produced by granulating in a liquid medium. The toner of the present invention can be obtained more suitably by dissolving/dispersing a toner material containing inorganic particulates using an organic solvent, and granulating in an aqueous medium followed by desolvation.

The toner produced by dry pulverization method has an amorphous shape, and moreover it tends to have a wide particle diameter distribution. Therefore, it is preferable to produce by granulating in the liquid medium in order to narrow the circularity distribution and the particle diameter distribution and to narrow the charge distribution of the toner. Specifically, it is possible to use a granulation method by forming liquid drops in a liquid medium using a method such as suspension polymerization, emulsification polymerization and dispersion polymerization.

To control the surface roughness Ra of the toner base particles, it is easy and preferable to use a method in which a different resin from the toner binding resin is adhered to the surface of the toner base particles. Regarding the different resin from the toner binding resin, it is possible to use a resin capable of forming an aqueous dispersion, and the resin may be a thermoplastic resin or a thermosetting resin. Examples of the resin includes vinyl based resins, polyurethane resins, epoxy resins, polyester resins, polyamide resins, polyimide resins, silicon based resins, phenol resins, melamine resins, urea resins, aniline resins, ionomer resins, and polycarbonate resins. The resin may be used alone or in combination of two or more.

Among them, the vinyl based resins, the polyurethane resins, the epoxy resins and the polyester resins, and combinations thereof are preferable in respect that the aqueous dispersion member of fine spherical resin particles are easily obtained. For example, the vinyl based resins include polymers obtained by homopolymerization or copolymerization of vinyl based monomers, e.g., resins such as styrene-(meth) acrylic acid ester copolymers, styrene-butadiene copolymers, (meth)acrylic acid-acrylic acid ester copolymers, styrene-acrylonitrile copolymers, styrene-maleic acid anhydrate copolymers and styrene-(meth)acrylic acid copolymers.

When a toner composition in which the above resin component is dissolved or dispersed in an organic solvent is dispersed in an aqueous medium, the resin component adheres as particulates to peripheries of oil drops present to prevent the coalescence of the oil drops, and the oil drops having uniform particle diameter are produced. This phenomenon contributes to stabilization of the dispersion. The surface roughness Ra of the toner base particles can be controlled by controlling the amount of the resin component to be added and the particle diameter of the resin particulates to be formed.

A method of adding a releasing agent in the toner may be given as a means to prevent the hot offset of the toner, which is a problem in the fixing process of the image forming process. The releasing agent comprised in the toner appears on the toner surface to develop a releasing property from a fixing member in association with deformation of the toner by receiving heat and pressure upon fixing. It is preferable that such releasing agent is enclosed without being exposed on the surface of the toner base particles because the wax exposed on the surface adheres to the surface of the frictional discharging member such as magnetic carrier to reduce the frictional charge property of the toner and exhibits an aggregation property to reduce the flowability of the toner.

Furthermore, the use of the method for adhering the foregoing resin particulates onto the surface of the toner base particles enables the releasing agent enclosed in the toner base particles to bleed only upon fixing, and the defects such as reduction of the toner charge property can be resolved in addition to the control of the surface roughness.

Regarding the releasing agent, a wax having a low melting point of 50° C. to 120° C. works effectively between a fixing roller and a toner boundary surface as the releasing agent in the dispersion with the binder resin, which is effective for a high-temperature offset without an application of a releasing agent such as oil on the fixing roller. Such wax components include the following. Examples of waxes include plant based waxes such as carnauba wax, cotton wax, tree wax and rice wax; animal based waxes such as bee wax and lanolin; mineral based waxes such as ozokerite and selsyn; and petroleum based waxes such as paraffin, microcrystalline and petrolatum. In addition to these natural waxes, synthetic hydrocarbon waxes such as Fischer-Tropsch waxes and polyethylene waxes, and synthetic waxes such as ester, ketone and ether are included. Furthermore, it is possible to use fatty acid amide such as 12-hydroxystearic acid amide, stearic acid amide, phthalic acid anhydrate imide and chlorinated hydrocarbon, and crystalline polymers having a long alkyl group in a side chain such as homopolymers and copolymers (e.g., copolymer of n-stearyl acrylate-ethyl methacrylate) of poly-n-stearyl methacrylate, poly-n-lauryl methacrylate which are crystalline polymer resins having low molecular weights.

The toner of the present invention is a toner obtained by dispersing in an aqueous medium a toner material, in which at least polyester prepolymer having a functional group comprising a nitrogen atom, polyester, a colorant and a releasing agent are dispersed in an organic solvent and by performing a crosslinking reaction and/or an extension reaction. Materials that compose the toner and suitable methods for production are described below.

(Polyester)

Polyester is obtained by polymerizing and condensing a polyvalent alcohol compound and a polyvalent carboxylic acid compound.

Examples of a polyvalent alcohol (PO) includes a divalent alcohol (DIO) and an trivalent or higher-valent alcohol (TO). DIO alone or a mixture of DIO with a small amount of TO is preferable. Divalent alcohols (DIO) include alkylene glycol (ethylene glycol, 1,2-propylene glycol, 1,3-propylene glycol, 1,4-butanediol and 1,6-hexanediol); alkylene ether glycol (diethylene glycol, triethylene glycol, dipropylene glycol, polyethylene glycol, polypropylene glycol and polytetramethylene ether glycol); alicyclic diol (1,4-cyclohexane dimethanol and hydrogenated bisphenol A); bisphenols (bisphenol A, bisphenol F and bisphenol S); alkylene oxide adducts of the above alicyclic diol (ethylene oxide, propylene oxide and butylene oxide); and alkylene oxide adducts of the above bisphenols (ethylene oxide, propylene oxide and butylene oxide). Among them, alkylene oxide adducts of alkylene glycol having 2 to 12 carbons and bisphenols are preferred. Particularly preferred are alkylene oxide adducts of bisphenols, and combinations of alkylene glycol having 2 to 12 carbons therewith. Alcohols with three or more valence (TO) include trivalent to octavalent or higher-valent polyvalent aliphatic alcohol (glycerin, trimethylolethane, trimethylolpropane, pentaerythritol and sorbitol); trivalent or more phenols (tris phenol PA, phenol novolack and cresol novolack); and alkylene oxide adducts of the above trivalent or higher-valent polyphenols.

Polyvalent carboxylic acid (PC) includes bivalent carboxylic acid (DIC) and trivalent or higher-valent carboxylic acid (TC). DIC alone or a mixture of DIC with TC in a small amount is preferable. Bivalent carboxylic acid DIC includes alkylene dicarboxylic acids (succinic acid, adipic acid and sebacic acid); alkenylene dicarboxylic acids (maleic acid, fumaric acid); aromatic dicarboxylic acids (phthalic acid, isophthalic acid, terephthalic acid and naphthalene dicarboxylic acid). Among them, alkenylene dicarboxylic acids having 4 to 20 carbons and aromatic dicarboxylic acids having 8 to 20 carbons are preferred. Trivalent or higher-valent carboxylic acids (TC) include aromatic polyvalent carboxylic acids (trimellitic acid, pyromellitic acid) having 9 to 20 carbons. As polyvalent carboxylic acid (PC), acid anhydrate or lower alkyl ester (methyl ester, ethyl ester and isopropyl ester) of the above may be used to react with polyvalent alcohol (PO).

The ratio of polyvalent alcohol (PO) to polyvalent carboxylic acid (PC) is typically 2/1 to 1/1, preferably 1.5/1 to 1/1, and more preferably 1.3/1 to 1.02/1 as an equivalent ratio of a hydroxyl group [OH] to a carboxyl group [COOH], i.e. [OH]/[COOH].

In the polymerization and condensation reaction, a polyvalent alcohol (PO) and a polyvalent carboxylic acid (PC) are heated to 150° C. to 280° C. under the presence of a heretofore known esterification catalyst such as tetrabutoxy titanate or dibutyltin oxide and distilling off produced water under reducing pressure if necessary to produce a polyester comprising a hydroxyl group. The hydroxyl value of the polyester is preferably 5 (mg KOH/g) or greater, and the acid value of the polyester is typically 1 to 30 (mg KOH/g), and preferably 5 to 20. The acid value gives the toner a negative charge property, and further the favorable affinity between recording paper and the toner improves the low-temperature fixing property an affinity between recording paper and the toner. However, when the acid value exceeds 30, the stability of the charging is prone to deteriorate with environmental variation.

A weight average molecular weight is 10,000 to 400,000, and preferably 20,000 to 200,000. The weight average molecular weight of less than 10,000 is not preferable because the hot offset resistance is reduced. When it exceeds 400,000, it is not preferable because the low-temperature fixing property is reduced.

(Polyester Prepolymer with a Functional Group Comprising a Nitrogen Atom (A))

The polyester preferably comprises a polyester modified with urea in addition to an unmodified polyester obtained by the above polymerization and condensation reaction. The urea modified polyester is obtained by reacting a polyvalent isocyanate compound (PIC) with a carboxyl group or a hydroxyl group at an end of the polyester obtained by the above polymerization and condensation reaction to yield a polyester prepolymer (A) comprising an isocyanate group, and reacting amines therewith to crosslink and/or extend the molecular chain.

Examples of the polyvalent isocyanate compound (PIC) include aliphatic polyvalent isocyanate (tetramethylene diisocyanate, hexamethylene diisocyanate and 2,6-diisocyanatomethyl caproate): alicyclic polyisocyanate (isophorone diisocyanate and cyclohexylmethane diisocyanate); aromatic diisocyanate (trilene diisocyanate and diphenylmethane diisocyanate); aromatic aliphatic diisocyanate (α,α,α',α'-tetramethyLxylylene diisocyanate); isocyanates; compounds obtained by blocking the above polyisocyanate with a phenol derivative, oxime, or caprolactam; and combinations of two or more thereof.

The ratio of the polyvalent isocyanate compound (PIC) is typically 5/1 to 1/1, preferably 4/1 to 2/1 and more preferably 2.5/1 to 1.5/1 as the equivalent ratio of isocyanate groups [NCO] to hydroxyl groups [α] of polyester having the hydroxyl groups, i.e. [NCO]/[OH]. When [NCO]/[OH] exceeds five, the low-temperature fixing property is reduced. When the molar ratio of [NCO] is less than one, the contained amount of urea portion becomes low with the use of the urea modified polyester, which consequently reduces the hot offset resistance.

The composition of isocyanate compound (PIC) in the polyester prepolymer (A) comprising an isocyanate group is typically 0.5% to 40% by mass, preferably 1% to 30% by mass and more preferably 2% to 20% by mass. When the amount is less than 0.5% by mass, the hot offset resistance is reduced, and at the same time, it is disadvantageous in terms of both heat-resistant storage stability and low-temperature fixing property. When it exceeds 40% by mass, the low-temperature fixing property is reduced.

The number of the isocyanate group comprised in one molecule of the polyester prepolymer (A) comprising an isocyanate groups is typically one or more, preferably an average of 1.5 to 3, and more preferably an average of 1.8 to 2.5. When the number of the isocyanate group is less than one per molecule, the molecular weight of the urea modified polyester is small, which reduces the hot offset resistance.

Examples of amines (B) to be reacted with the polyester prepolymer (A) comprising an isocyanate group include bivalent amine compounds (B1), trivalent or higher-valent amine compounds (B2), amino alcohol (B3), aminomercaptan (B4), amino acids (B5) and those obtained by blocking the amino groups in B1 to B5 (B6).

Examples of the bivalent amine compounds (B1) include aromatic diamine (phenylene diamine, diethyltoluene diamine and 4,4'-diaminodiphenylmethane); alicyclic diamine, (4,4'-diamino-3,3'-dimethyldicyclohexylmethane, diamine cyclohexane and isophorone diamine); and aliphatic diamine (ethylenediamine, tetramethylenediamine and hexamethylenediamine).

Examples of trivalent or higher-valent amine compounds (B2) include diethylenetriamine and triethylenetetraamine.

Examples of amino alcohols (B3) include ethanol amine and hydroxyethylaniline.

Examples of aminomercaptan (B4) include aminoethylmercaptan and aminopropylmercaptan.

Examples of amino acids (B5) include aminopropionic acid and aminocaproic acid.

Those obtained by blocking the amino group in B1 to B5 (B6) include ketimine compounds and oxazolidine compounds obtained from amines and ketones (acetone, methyl ethyl ketone and methyl isobutyl ketone) of the above B1 to B5. Among these amines, B1 and a mixture of B1 with a small amount of B2 are preferred.

The ratio of amines (B) is typically ½ to 2/1, preferably 1.5/1 to 1/1.5 and more preferably 1.2/1 to 1/1.2 as the equivalent ratio of the isocyanate groups [NCO] in the polyester prepolymer (A) comprising an isocyanate group to the amino groups [NHx] in amines (B), i.e. [NCO]/[NHx].

When [NCO]/[NHx] is greater than two or is less than ½, the molecular weight of the urea modified polyester becomes low, and the hot offset resistance is reduced.

The urea modified polyester may also comprise a urethane bond as well as a urea bond. The molar ratio of the urea bonds to the urethane bonds to be contained is typically 100/0 to 10/90, preferably 80/20 to 20/80, and more preferably 60/40 to 30/70. When the molar ratio of the urea bond is less than 10%, the hot offset resistance is reduced.

The urea modified polyester is produced by a one-shot method.

A polyester comprising a hydroxyl group is obtained by heating polyvalent alcohol (PO) and polyvalent carboxylic acid (PC) to 150° C. to 280° C. under the presence of a heretofore known esterification catalyst such as tetrabutoxy titanate or dibutyltin oxide and distilling off the produced water under reducing pressure if necessary. Then, this is reacted with polyvalent isocyanate (PIC) at 40° C. to 140° C. to yield the polyester prepolymer (A) comprising an isocyanate group. Furthermore, amines (B) is reacted this (A) at 0° C. to 140° C. to yield the urea modified polyester.

A solvent can also be used as needed in the reaction of PIC or in the reaction of the polyester prepolymer (A) and amines (B). Examples of a usable solvent include those such as aromatic solvents such as toluene and xylene; ketones such as acetone, methyl ethyl ketone and methyl isobutyl ketone; esters such as ethyl acetate; amides such as dimethylformamide and dimethylacetamide; and ethers such astetrahydrofuran, which are inert for isocyanate (PIC).

The molecular weight of the resulting urea modified polyester can be adjusted with a reaction terminator if necessary in the crosslinking reaction and/or the extension reaction of the polyester prepolymer (A) and amines (B). Examples of the reaction terminator include monoamine such as diethylamine, dibutylamine, butylamine and laurylamine; and those obtained by blocking them such as ketimine compounds.

The weight average molecular weight of the urea modified polyester is typically 10,000 or more, preferably 20,000 to 10,000,000 and more preferably 30,000 to 1,000,000. When it is less than 10,000, the hot offset resistance is reduced. The number average molecular weight of the urea modified polyester is not particularly limited when the above unmodified polyester is used, and the number average molecular weight may be adjusted so that the above weight average molecular weight is easily obtained. When the urea modified polyester is used alone, the number average molecular weight thereof is typically 2,000 to 20,000, preferably 2,000 to 10,000 and more preferably 2,000 to 8,000. When it exceeds 20,000, the low-temperature fixing property and the luster property for a full-color apparatus are reduced.

Since the low-temperature fixing property and the luster property for a full-color apparatus are enhanced by combining the unmodified polyester with the urea modified polyester, the combination is more preferable than the case of using the urea modified polyester alone. The unmodified polyester may comprise a polyester modified with chemical bonds other than urea bonds.

It is preferable in terms of low-temperature fixing property and hot offset resistance that the unmodified polyester and the urea modified polyester are at least partially compatible. Therefore, it is preferable that the unmodified polyester and the urea modified polyester have similar compositions.

The mass ratio of the unmodified polyester to the urea modified polyester is typically 20/80 to 95/5, preferably 70/30 to 95/5, more preferably 75/25 to 95/5 and particularly preferably 80/20 to 93/7. When the mass ratio of the urea modified polyester is less than 5%, the hot offset resistance is reduced, and at the same time it is disadvantageous in terms of balancing the heat resistant storage stability and the low-temperature fixing property.

The glass transition point (Tg) of the binder resin comprising the unmodified polyester and the urea modified polyester is typically 45° C. to 65° C., and preferably 45° C. to 60° C. When it is lower than 45° C., the toner heat resistance is reduced; whereas when it is higher than 65° C., the low-temperature fixing property is insufficient.

The urea modified polyester tends to present on the surface of the resulting toner base particles. Therefore, even when the glass transition point is lower compared to a heretofore known polyester based toner, the heat resistant storage stability is favorable.

—Colorants—

Regarding the colorants, heretofore known dyes and pigments such as the following may be used: carbon black, nigrosine dyes, iron black, naphthol yellow S, hanza yellow (10G, 5G, G), cadmium yellow, yellow iron oxide, yellow ocher, chrome yellow, titanium yellow, polyazo yellow, oil yellow, hanza yellow (GR, A, RN, R), pigment yellow L, benzidine yellow (G, GR), permanent yellow (NCG), Balkan fast yellow (5G, R), tartrazine lake, quinoline yellow lake, anthrazane yellow BGL, isoindolinone yellow, colcothar, red lead, lead vermillion, cadmium red, cadmium mercury red, antimony vermillion, permanent red 4R, parared, faicer red, parachloroorthonitroaniline red, lithol fast scarlet G, brilliant fast scarlet, brilliant carmine BS, permanent red (F2R, F4R, FRL, FRLL, F4RH), fast scarlet VD, Balkan fast rubine B, brilliant scarlet G, lithol rubine GX, permanent red F5R, brilliant carmine 6B, pigment scarlet 3B, Bordeaux 5B, toluidine maroon, permanent Bordeaux F2K, helio Bordeaux BL, Bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, non-metallic phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green, phthalocyanine green, anthraquinone green, titanium oxide, zinc flower, lithopone and mixtures thereof.

The content of the above colorant is typically 1% to 15% by mass, and preferably 3% to 10% by mass based on the toner.

The above colorants may be used as a master batch which is a complex with the resin. Examples of a binder resin used for producing the master batch or kneaded with the master batch includes the following: polymers of styrene and derivative thereof such as polystyrene, poly-p-chlorostyrene and polyvinyl toluene, or copolymers of vinyl compounds therewith, polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylic acid resins, rosin, modified rosin, terpene resins, aliphatic or alicyclic hydrocarbon resins, aromatic petroleum resins, chlorinated paraffin and paraffin wax. These may be used alone or in combination.

—Charge Controller—

A heretofore known charge controller may be used, and examples thereof include nigrosine based dyes, triphenylmethane based dyes, chromium containing metal complex dyes, molybdic acid chelated pigments, rhodamine based dyes, alkoxy based amine, quaternary ammonium salts (including fluorine modified quaternary ammonium salts), alkylamide, a single substance or compounds of phosphorous, a single substance or compounds of tungsten, fluorine based activator, metal salts such as salicylate metal salts and salicylate derivatives. Specifically, Bontron 03 which is the nigrosine based dye, Bontron P-51 which is the quaternary ammonium salt, Bontron S-34 which is a metal containing azo dye, E-82 which is an oxynaphthoic acid based metal complex, E-84 which is a salicylic acid based metal complex and E-89 which is a phenol based condensate which are manufactured by Orient Chemical Industries Ltd., TP-302 and TP-415 which are quaternary ammonium salt molybdate complexes, which are manufactured by Hodogaya Chemical Co., Ltd., Copy Charge PSY VP2038 which is the quaternary ammonium salt, Copy Blue PR which is a triphenylmethane derivative, Copy Charge NEG VP2036 and Copy Charge NX VP434 which are the quaternary ammonium salts, which are manufactured by Hoechst AG, LR-147 which is a boron complex (manufactured by Japan Carlit Co., Ltd.), copper phthalocyanine, perylene, quinacridone, azo based pigments, and additionally polymer compounds having a functional group such as sulfonate, carboxyl groups and quaternary ammonium salts. Among them, a substance which controls the toner to negative polarity is preferably used.

The amount of the charge controller to be used depends on the toner production method including the type of the binder resin, the presence or absence of the optionally used additives and the dispersion method. The amount is not clearly defined, but it is preferably in the range of 0.1 parts to 10 parts by mass based on 100 parts by mass of the binder resin. Preferably, it is in the range of 0.2 parts to 5 parts by mass. When the amount exceeds 10 parts by mass, the charge property of the toner is excessively large, the effect of the charge controller is reduced, and the electrostatic suction power to the development roller is increased, resulting in flowability reduction of the developer and reduction of an image density in some cases.

—Releasing Agent—

As a releasing agent, a wax having a low melting point of 50° C. to 120° C. works effectively between a fixing roller and a toner boundary surface as the releasing agent in the dispersion with the binder resin, and this is effective for a high-temperature offset without an application of a releasing agent such as oil on the fixing roller. Examples of such wax component includes plant based waxes such as carnauba wax, cotton wax, tree wax and rice wax; animal based waxes such as bee wax and lanolin; mineral based waxes such as ozokerite and selsyn; and petroleum based waxes such as paraffin, microcrystalline and petrolatum. In addition to these natural waxes, synthetic hydrocarbon waxes such as Fischer-Tropsch waxes and polyethylene waxes, and synthetic waxes of ester, ketone and ether are included. Furthermore, it is possible to use a fatty acid amide such as 12-hydroxystearic acid amide, stearic acid amide, phthalic acid anhydrate imide and chlorinated hydrocarbon, and crystalline polymers having a long alkyl group in a side chain such as homopolymers and copolymers (e.g., copolymer of n-stearyl acrylate-ethyl methacrylate) of poly-n-stearyl methacrylate, poly-n-lauryl methacrylate which are crystalline polymer resins having low molecular weights.

The charge controller and the releasing agent can be melted and kneaded with the master batch and the binder resin, or they may also be added when dissolved and dispersed in the organic solvent. Substances described above may be used for the releasing agent and the inorganic particulates.

(Method for Producing Toner)

Subsequently, the method for producing the toner is described. Herein, a preferable production method is described, but this is not to be construed as limiting a production method of the present invention.

(1) A toner material solution is made by dispersing a colorant, an unmodified polyester, a polyester prepolymer comprising an isocyanate group and a releasing agent in an organic solvent.

It is preferable that the organic solvent is volatile with a boiling point lower than 100° C. in terms of an easy removal after forming toner base particles. Specifically, water-insoluble or water-immiscible compounds such as toluene, xylene, benzene, carbon tetrachloride, methylene chloride, 1,2-dichloroethane, trichloroethylene, chloroform, monochlorobenzene, dichloroethylidene, methyl acetate, ethyl acetate, methyl ethyl ketone and methyl isobutyl ketone may be used alone or in combination of two or more. In particular, aromatic solvents such as toluene and xylene, and halogenated hydrocarbon such as methylene chloride, 1,2-dichloroethane, chloroform and carbon tetrachloride are preferable. The amount of the organic solvent to be used is typically 0 parts to 300 parts by mass, preferably 0 parts to 100 parts by mass and more preferably 25 parts to 70 parts by mass based on 100 parts by mass of the polyester prepolymer.

Herein, it is preferable to disperse inorganic particulates inside the toner, more preferably in the vicinity of the surface in order to control toner shapes. It is possible to make the shape of the toner surface concavoconvex by taking advantage of the shape of the inorganic particulates or the difference of the shrinking speed within the toner in an emulsification desolvation process. The inorganic particulates and the desolvation are particularly effective for enlarging the cycle (i.e. reducing the value of RMS of the degree of concavoconvex), i.e. 'further deepening a depth of the concave portion of the concavoconvex,' as well as enlarging the surface roughness (Ra). The substances described above may be used for the inorganic particulates; among these, inorganic particulates such as silica and more preferably organosilica are more preferable in terms of shape control or charge stability over timeor environmental charge stability.

(2) The toner material solution is emulsified in an aqueous medium under the presence of a surfactant and resin particulates.

The aqueous medium may be water alone or water comprising an organic solvent such as alcohol (methanol, isopropyl alcohol and ethylene glycol), dimethylformamide, tetrahydrofuran, cellsolves (methyl cellsolve) and lower ketones (acetone and methyl ethyl ketone).

The amount of the aqueous medium to be used is typically 50 parts to 2,000 parts by mass and preferably 100 parts to 1,000 parts by mass based on 100 parts by mass of the toner material solution. When the amount is less than 50 parts by mass, the toner material solution is not dispersed well, and the toner base particles having given particle diameter are not obtained. When it exceeds 2,000 parts by mass, it is not economical.

Dispersants such as surfactant and resin particulates are optionally added in order to well disperse toner material liquid drops (crosslinked or extended during a dispersion process) in the aqueous medium.

Example of the surfactant include anionic surfactants such as alkylbenzenesulfonate salts, α-olefin sulfonate salts and phosphate ester, cationic surfactants such as amine salt types such as alkylamine salts, amino alcohol fatty acid derivatives, polyamine, fatty acid derivatives and imidazoline, and quaternary ammonium salt types such as alkyltrimethylammonium salts, dialkyldimethylammonium salts, alkyldimethylbenzylammonium salts, pyridinium salts, alkylisoquinolinium salts and benzethonium chloride, nonionic surfactants such as fatty acid amide derivatives and polyvalent alcohol derivatives, and ampholytic surfactant such as alanine, dodecyldi(aminoethyl)glycine, di(octylaminoethyl)glycine and N-alkyl-N,N-dimethylammonium betaine.

A surfactant comprising a fluoroalkyl group is advantageous since the use of an extremely small amount of the surfactant is effective. The preferably used anionic surfactants comprising a fluoroalkyl group include fluoroalkyl carboxylic acids having 2 to 10 carbons and metal salts thereof, disodium perfluorooctanesulfonyl glutamate, sodium 3-[cofluoroalkyl (6 to 11 carbons)oxy]-1-alkyl (3 to 4 carbons) sulfonate, sodium 3-[ω-fluoroalkanoyl (6 to 8 carbons)-N-ethylamono]-1-propane sulfonate, fluoroalkyl (11 to 20 carbons) carboxylic acids and metal salts thereof, perfluoroalkyl carboxylic acids (7 to 13 carbons) and metal salts thereof, perfluoroalkyl (4 to 12) sulfonic acids and metal salts thereof, perfluorooctane sulfonic acid diethanol amide, N-propyl-N-(2-hydroxyethyl)perfluorooctane sulfone amide, perfluoroalkyl (6 to 10 carbons) sulfone amide propyltrimethyl ammonium salts, perfluoroalkyl (6 to 10 carbons)-N-ethylsulfonyl glycine salts and perfluoroalkyl (6 to 16 carbons) ethyl phosphate ester. Trade names thereof include Surflon S-111, S-112 and S-113 (manufactured by Asahi Glass Co., Ltd.), Fluorad FC-93, FC-95, Fc-98 and FC-129 (manufactured by Sumitomo Three M Co., Ltd.), Unidain DS-101 and DS-102 (manufactured by Daikin Industries Ltd.), Megafac F-110, F-120, F-113, F-191, F-812 and F-833 (manufactured by Dainippon Ink And Chemicals, Incorporated), EFTOP EF-102, 103, 104, 105, 112, 123A, 123B, q306A, 501, 201 and 204 (manufactured by Tohchem Products Co., Ltd.) and FTARGENT F-100 and F-105 (manufactured by Neos Co., Ltd.).

The cationic surfactants include aliphatic primary secondary or tertiary amic acids having fluoroalkyl groups, aliphatic quaternary ammonium salts such as perfluoroalkyl (6 to 10 carbons) sulfonamide propyltrimethyl ammonium salts, and benzalkonium salts, benzethonium chloride, pyridinium salts, imidazolium salts, and as the trade names, Surflon S-121 (manufactured by Asahi Glass Co., Ltd.), Fluorad FC-135 (manufactured by Sumitomo Three M Co., Ltd.), Unidain DS-202 (manufactured by Daikin Industries Ltd.), Megafac F-150 and F-824 (manufactured by Dainippon Ink And Chemicals, Incorporated), EFTOP EF-132 (manufactured by Tohchem Products Co., Ltd.), and FTARGENT F-300 (manufactured by Neos Co., Ltd.).

The resin particulates (organic particulates) are added in order to stabilize the toner base particles formed in the aqueous medium and to provide the surface roughness.

The effect on the concavoconvex of the toner surface varies depending on the particle diameter of the resin particulates and the adhering conditions (embedment, planar deformation or partial desorption (by acid, alkali, solvent or mechanical treatment) of the resin particulates on the toner surface. Ra as well as RMS is large when the resin particulates having a larger particle diameter are adhered to the surface of the spherical toner while maintaining the shape of the resin particulates. On the other hand, Ra as well as RMS becomes small when the resin particulates are small or the toner has embedment, planar deformation or a partial desorption inside the toner. Meanwhile, the value of RMS is easily affected by the shape having a large cycle as well as the resin particulates. Thus, it is often difficult to control the value of RMS by solely controlling the organic particulates. The large cycle may be easily modified by taking advantage of the inorganic particulates and additionally the shrinkage of the desolvation.

It is preferable to add the resin particulates so that the fraction of resin particulates coating over the surface of the toner base particles is in the range of 10% to 90%. Examples thereof include polymethacrylic acid methyl particulates of 1 μm and 3 μm, polystyrene particulates of 0.2 μm and 2 μm, poly(styrene-acrylonitrile) particulates of 1 μm, and as the trade names, PB-200H (manufactured by Kao Corporation), SGP (manufactured by Soken Chemical & Engineering Co., Ltd.), Technopolymer SB (manufactured by Sekisui Plastics Co., Ltd.), SGP-3G (manufactured by Soken Chemical & Engineering Co., Ltd.) and Micropearl (manufactured by Sekisui Fine Chemical Co., Ltd.).

Inorganic compound dispersants such as tricalcium phosphate, calcium carbonate, titanium oxide, colloidal silica and hydroxyapatite can also be used.

Polymer based protection colloid may be used as a dispersant (or dispersion stabilizer) to stabilize the dispersed liquid drops in combination with the foregoing resin particulates and inorganic compound dispersant. Examples thereof include homopolymers or copolymers of the following compounds: acids such as acrylic acid, methacrylic acid, α-cyanoacrylic acid, α-cyanomethacrylic acid, itaconic acid, crotonic acid, fumaric acid, maleic acid and maleic acid anhydrate; (meth)acrylic monomers comprising a hydroxyl group such as acrylic acid-β-hydroxylethyl, methacrylic acid-β-hydroxylethyl, acrylic acid-β-hydroxylpropyl, methacrylic acid-β-hydroxylpropyl, acrylic acid-γ-hydroxylpropyl, methacrylic acid-γ-hydroxylpropyl, acrylic acid-3-chloro-2-hydroxylpropyl, methacrylic acid-3-chloro-2-hydroxylpropyl, diethylene glycol monoacrylate ester, diethylene glycol monomethacrylate ester, glycerin monoacrylate ester, glycerin monomethacrylate ester and N-methylol methacrylamide; vinyl alcohols or ethers with vinyl alcohol such as vinyl methyl ether, vinyl ethyl ether and vinyl propyl ether; esters of vinyl alcohol with a compound comprising a carboxylic group such as vinyl acetate, vinyl propionate and vinyl butyrate; acrylamide, methacrylamide, diacetone acrylamide, and methylol compounds thereof; acid chlorides such as acrylate chloride and methacrylate chloride; nitrogen-containing compounds such as vinyl pyridine, vinyl pyrrolidone, vinyl imidazole and ethylene imine; and those comprising a heterocyclic ring thereof. More examples of the polymer based protection colloid include polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearylphenyl ether and polyoxyethylene nonylphenyl ester, and celluloses such as methylcellulose, hydroxyethylcellulose and hydroxypropylcellulose.

The method of dispersion is not particularly limited, and heretofore known equipments such as low-speed shearing method, high-speed shearing method, high-pressure jet method and ultrasonic method may be applied. Among them, the high-speed searing method is preferable for making the particle diameter of the dispersion 2 μm to 20 μm. The rotational frequency of a high speed shearing dispersion machine is not particularly limited, but it is typically 1,000 rpm to 30,000 rpm and preferably 5,000 rpm to 20,000 rpm. The dispersion time period is not particularly limited, but it is typically 0.1 minutes to 5 minutes in the case of a batch mode. The temperature during dispersion is typically 0° C. to 150° C. (under pressure) and preferably 40° C. to 98° C.

The releasing agent can be comprised in the aqueous medium phase because it can transfer to the organic solvent phase due to its lipophilicity even if it is initially comprised in the aqueous medium phase. However, it is more preferable that the releasing agent is comprised in the organic solvent phase.

(3) Amines (B) is added simultaneously with the production of an emulsified liquid to react with the polyester prepolymer (A) comprising an isocyanate group.

This reaction accompanies crosslinking and/or extension of the molecular chain. The duration of the reaction is selected based on the reactivity of amines with the isocyanate group structure of the polyester prepolymer (A). It is typically 10 minutes to 40 hours, and preferably 2 hours to 24 hours. The reaction temperature is typically 0° C. to 150° C., and preferably 40° C. to 98° C. A heretofore known catalyst can be used as needed. Examples of the catalyst includes dibutyltin laurate and dioctyltin laurate.

(4) After the reaction is completed, the organic solvent is removed from an emulsified dispersion (reactant), and the emulsified dispersion is then washed and dried to yield toner base particles.

The entire system is gradually heated with laminar stirring; a strong agitation is given at a certain temperature range followed by desolvation to removed the organic solvent, which as a result produces spindle-shaped toner base particles. When a compound which may dissolve in acid and alkali solution such as calcium phosphate salt is used as a dispersion stabilizer, the calcium phosphate salt is removed from the toner base particles by dissolving the salt with acid such as hydrochloric acid and then washing with water. Additionally, the dispersion stabilizer can be removed by decomposition with an enzyme.

(5) A charge controller is added to the toner base particles obtained above, and then inorganic particulates such as silica particulates and titanium oxide particulates are added externally to obtain the toner.

The addition of the charge controller and the external addition of the inorganic particulates are performed by heretofore known methods using a mixer.

By this a toner with small particle diameter and sharp particle diameter distribution is easily obtained. In addition, the shape can be controlled from a pearl shape to a spindle shape by strong agitation in the process of removing the organic solvent, and furthermore, surface morphology can be controlled from a smooth shape to a dimple shape.

(Developer)

A developer of the present invention comprises the toner of the present invention and optionally selected other components such as carrier. The developer may be a one-component developer or a two-component developer, and the two-component developer is preferable in terms of enhanced lifetime when used for high speed printers compatible with the recent enhancement in information processing speed.

In the case of the one-component developer with the toner of the present invention, there is little variation in the toner particle diameter even though the toner is balanced. Since there is no filming of the toner to a developing roller and no fusion of the toner to a member such as blade that makes the toner a thin layer, favorable and stable developing property and images are achieved during the prolonged use (stirring) of the developing unit. Regarding the two-component developer with the toner of the present invention, there is little variation of toner particle diameter in the developer even though the toner is balanced over a prolonged period of time, and favorable and stable developing property are obtained in stirring in the developing unit for a prolonged period of time.

The foregoing carrier is not particularly limited and can be optionally selected depending on the purpose, but those having a core material and a resin layer which coats the core material are preferable.

Materials for the core material are not particularly limited, and can be optionally selected from those heretofor known. For example, manganese-strontium (Mn—Sr) based materials and manganese-magnesium (Mn—Mg) based materials of 50 emu/g to 90 emu/g are preferable. In terms of assuring the image density, highly magnetized materials such as iron powder (100 emu/g or greater) and magnetite (75 emu/g to 120 emu/g) are preferable. Weakly magnetized materials such as copper-zinc (Cu—Zn) based materials (30 emu/g to 80 emu/g) are preferable in the respect that the contact of the toner in a spike-standing state with the photoconductor can be softened and that it is advantageous for making the image have high quality. These may be used alone or in combination of two or more.

Regarding the particle diameter of the core material, an average particle diameter, i.e. the volume average particle diameter (D50), is preferably 10 μm to 200 μm, and more preferably 40 μm to 100 μm.

When the average particle diameter, i.e. volume average particle diameter (D50), is less than 10 μm, the fraction of fine powder increases, and magnetization per particle becomes low to cause carrier scattering in some cases. When it exceeds 200 μm, the specific surface area is reduced to cause toner scattering in some cases, and in particular, affect the reproduction of solid images in a full-color printing comprising many solid images.

Materials for the resin layer are not particularly limited and can be optionally selected from heretofore known resins depending on the purpose. Examples thereof include amino based resins, polyvinyl based resins, polystyrene based resins, halogenated olefin resins, polyester based resins, polycarbonate based resins, polyethylene resins, polyfluorovinyl resins, polyfluorovinylidene resins, polytrifluoroethylene resins, polyhexafluoropropylene resins, copolymers of fluorovinylidene and acryl monomer, copolymers of fluorovinylidene and fluorovinyl, fluoroterpolymer such as terpolymer of tetrafluoroethylene and fluorovinylidene and non-fluoride monomer and silicone resins. These may be used alone or in combination of two or more.

The amino based resins include, for example, urea-formaldehyde resins, melamine resins, benzoguanamine resins, urea resins, polyamide resins and epoxy resins. The polyvinyl based resins include, for example, acryl resins polymethyl methacrylate resins, polyacrylonitrile resins, polyvinyl acetate resins, polyvinyl alcohol resins and polyvinyl butyral resins. The polystyrene based resins include, for example, polystyrene resins and styrene-acryl copolymer resins. The halogenated olefin resins include, for example, polyvinyl chloride. The polyester based resins include, for example, polyethylene terephthalate resins and polybutylene terephthalate resins.

Conductive powder may be comprised in the resin layer as needed, and the conductive powder includes, for example, metal powder, carbon black, titanium oxide, tin oxide and zinc oxide. The average particle diameter of these conductive powder is preferably 1 μm or less. When the average particle diameter exceeds 1 μm, it becomes difficult to control the electric resistance in some cases.

The resin layer can be formed by dissolving a silicone resin in the solvent to prepare a coating solution, subsequently applying the coating solution uniformly on the surface of the core material by a heretofore known coating method and drying followed by calcination. The coating method includes, for example, a dipping method, a spraying method and a brushing method.

The above solvent is not particularly limited can be optionally selected depending on the purpose. Examples thereof include toluene, xylene, methyl ethyl ketone, methyl isobutyl ketone and cellsolve butyl acetate.

The method of calcination is not particularly limited; it may be an external heating method or an internal heating method. Examples thereof include methods using a fixed electric furnace, a fluid electric furnace, a rotary electric furnace and a burner furnace; and a method using microwaves.

The amount of the resin layer in the carrier is preferably 0.01% to 5.0% by mass. When the amount is less than 0.01% by mass, the uniform resin layer can not be formed on the surface of the core material in some cases. When it exceeds 5.0% by mass, the resin layer becomes excessively thick to cause granulation within the carrier, and thus uniform carrier particles can not be obtained in some cases.

When the developer is a two-component developer, the content of the carrier in the two-component developer is not particularly limited and can be optionally selected depending on the purpose. For example, it is preferably 90% to 98% by mass and more preferably 93% to 97% by mass.

In general, the mixing ratio of the toner to the carrier in the two-component developer is preferably 1 parts to 10.0 parts by mass of the toner based on 100 parts by mass of the carrier.

The developer of the present invention comprises the toner of the present invention. Therefore, the occurrence of photoconductor filming can be prevented, there is, and it is possible to stably form an excellent and sharp images having high quality and no variation in the unevenness of image.

(Process Cartridge)

The process cartridge of the present invention comprises a latent image bearing member which bears a latent electrostatic image and a developing unit configured to develop the latent electrostatic image borne on the latent image bearing member using a toner to form a visible image; it further comprises other units optionally selected as needed such as a charging unit, developing unit, transferring unit, cleaning unit and neutralizing unit.

The developing unit comprises a developer container in which the toner or the developer of the present invention is held and a developer bearing member which bears and delivers the toner or the developer held in the developer container, and it may further comprises a layer thickness controlling member for controlling the layer thickness of the borne toner.

The process cartridge of the present invention can be detachably provided for various electrograph apparatuses, facsimiles and printers, and preferably, it is detachably provided for the image forming apparatus of the present invention described hereinafter.

Herein, the process cartridge, for example as shown in FIG. 1, comprises a built-in photoconductor 101, a charging unit 102, a developing unit 104, a transferring unit 108 and a cleaning unit 107; it further comprises other units as needed. In FIGS. 1, 103 and 105 represent exposure by an exposing unit and a recording medium, respectively.

The photoconductor 101 may be the one similar to that employed by the image forming apparatus described later. An optional charging member is used for the charging unit 102.

Next, an image forming process by the process cartridge shown in FIG. 1 is described. A latent electrostatic image corresponding to an exposure image is formed on the surface of the photoconductor 101 rotating in the direction of the arrow, with charging by the charging unit 102 and exposure 103 by the exposing unit (not shown in the figure). This latent electrostatic image is toner-developed in the developing unit 104. The toner-developed image is transferred by the transferring unit 108 onto the recording medium 105 and printed out. Then, the photoconductor surface after transferring the image is cleaned by the cleaning unit 107 and further neutralized by the neutralizing unit (not shown in the figure). The above operations are repeated again.

Regarding the image forming apparatus of the present invention, the latent image bearing member and constituent elements such as developing section and cleaning section are integrated into the process cartridge, and this unit may detachably constitute the main body of the apparatus. Alternatively, the process cartridge may be formed by integrating at least one of a charging section, an image exposing section, the developing section, a transferring or separating section and the cleaning section with the latent image bearing member to make a detachable single unit in the main body of the apparatus, and the single unit may be made detachable guiding units such as rails in the main body of the apparatus.

(Image Forming Apparatus and Image Forming Method)

The image forming apparatus of the present invention comprises a latent image bearing member, a latent electrostatic image forming unit, a developing unit, a transferring unit and a fixing unit; it further comprises other units such as a neutralizing unit, cleaning unit, recycling unit and controlling unit optionally selected as needed.

The image forming method of the present invention comprises a latent electrostatic image forming process, a developing process, a transferring process and a fixing process; and it further comprises other processes such as a neutralizing process, cleaning process, recycling process and controlling process optionally selected as needed.

The image forming method of the present invention can be favorably carried out by the image forming apparatus of the present invention; the latent electrostatic image forming process can be carried out by the latent electrostatic image forming unit; the developing process can be carried out by the developing unit; the transferring process can be carried out by the transferring unit; the fixing process can be carried out by the fixing unit; and the other processes can be carried out by the other units.

—Latent Electrostatic Image Forming Process and Latent Electrostatic Image Forming Unit—

The latent electrostatic image forming process is a process of forming a latent electrostatic image on the latent image bearing member.

The latent image bearing member (sometimes referred to as an 'electrographic photoconductor' or a 'photoconductor') is not particularly limited in terms of material, shape, structure and size, and it can be appropriately selected from those heretofore known. However, the shape is favorably a drum shape, and the materials thereof include inorganic photoconductors such as amorphous silicon and selenium, and organic photoconductors such as polysilane and phthalopolymethine. Among them, amorphous silicon is preferable in terms of long lifetime.

Regarding the amorphous silicon photoconductor, it is possible to use a photoconductor having a photoconductive layer composed of a-Si (sometimes referred to as an 'a-Si based photoconductor'), obtained by heating a support to 50° C. to 400° C. and making the layer on the support by a film forming method such as vacuum deposition method, spattering method, ion plating method, thermal CVD method, photo-assisted CVD method and plasma CVD method. Among them, the plasma CVD method, i.e. the method in which a source gas is decomposed by direct current, high frequency or microwave glow discharge to form an a-Si deposition film on the support, is favorable.

The latent electrostatic image can be formed by charging the surface of the latent image bearing member and subsequently exposing according to the image; it can be performed with the latent electrostatic image forming unit.

The latent electrostatic image forming unit comprises the charging section which charges the surface of the latent image bearing member and the exposing section which exposes the surface of the latent image bearing member according to the image.

The charging can be performed by applying a voltage onto the surface of the latent image bearing member using the charging section.

The charging section is not particularly limited, and it can be optionally selected depending on the purpose. Examples thereof include contact charging sections per se heretofore known comprising a conductive or semi-conductive roller, brush, film and rubber blade; and non-contact charging section that uses corona discharge such as corotron and scorotron.

The shape of the charging member may be of any form such as magnetic brush and fur brush in addition to roller, and it can be selected in concert with the specification and the form of the electrograph apparatus. When the magnetic brush is used, the magnetic brush uses various ferrite particles such as Zn—Cu ferrite as the charging member and is composed of a non-magnetic conductive sleeve for supporting the particles and a magnet roll enclosed in the sleeve. Also, when a brush is used, for example, a fur conductively treated with carbon, copper sulfide, metal or metal oxide is used as the material of the fur brush, and the charging section is made by looping or attaching the fur to a metal or other conductively treated core grids.

The charging section is not limited to the above contact type charging sections. However, it is preferable to use a contact type charging section since an image forming apparatus with reduced ozone generated from the charging section is obtained.

The exposure can be performed by exposing the surface of the latent image bearing member according to the image using the exposing section.

The exposing section is not particularly limited as long as the exposure can be performed according to the image on the surface of the latent image bearing member charged by the charging section, and it can be optionally selected depending on the purpose. Examples thereof include various exposing sections such as replicating optical, rod lens alley based, laser optical and liquid-crystal shutter optical exposing sections.

In the present invention, a back-lighting method in which the exposure is performed according to the image from the backside of the latent image bearing member may be employed.

—Developing Process and Developing Unit—

The developing process is a process of developing the latent electrostatic image using the toner or the developer of the present invention to form a visible image.

The formation of the visible image can be performed by developing the latent electrostatic image using the toner or the developer of the present invention, and it can be performed by the developing unit.

The developing unit is not particularly limited as long as the development can be performed using the toner or the developer of the present invention. It can be optionally selected from those heretofore known, and suitable examples include those comprising a developing section which holds the toner or the developer of the present invention and can impart the toner or the developer of the present invention to the latent electrostatic image with or without contact. A developing section comprising a vessel with the toner of the present invention is more preferable.

In the developing unit, the developer is borne and delivered by the latent image bearing member. An alternating electric field is applied at a position opposite to the latent image bearing member, and the latent electrostatic image on the latent image bearing member is developed, where the developer of the present invention is used as the developer.

The developing section may be a dry developing system or a wet developing system; moreover, it may be a single-color development section or a multi-color developing section. Suitable examples thereof include those having a stirring section which charges the toner or the developer by rubbing and stirring; and those having a rotatable magnet roller.

In the developing section, the toner and the carrier are mixed and stirred, for example, where the toner is charged by friction and maintained in a spike-standing state on the surface of a rotating magnet roller to form a magnetic brush. The magnet roller is disposed in the vicinity of the latent image bearing member (photoconductor). Thus, a part of the toner which composes the magnetic brush formed on the surface of the magnet roller transfers to the surface of the latent image bearing member (photoconductor) by electrical attractive force. As a result, the latent electrostatic image is developed by the toner, and a visible image by the toner is formed on the latent image bearing member (photoconductor).

The developer held in the developing section is a developer comprising the toner of the present invention. The developer may be a one-component developer or a two-component developer. The toner comprised in the developer is the toner of the present invention.

—Transferring Process and Transferring Unit—

The transferring process is a process that transfers the visible image to a recording medium. A preferable aspect is where, by employing an intermediate transferring member, the visible image is primarily transferred to the intermediate transferring member, and subsequently the visible image is secondarily transferred to the recording medium. A more preferable aspect comprises, with a toner with two or more colors or preferably a full-color toner as the toner, a primary transferring process where a complex transfer image is formed by transferring the visible image onto the intermediate transferring member and a secondary transferring process where the complex transfer image is transferred onto the recording medium.

The transfer can be performed by charging the visible image formed on the latent image bearing member (photoconductor) using a transferring and charging section, and it can be performed by the transferring unit. Regarding the transferring unit, the aspect having the primary transferring unit where the complex transfer image is formed by transferring the visible image onto the intermediate transferring member and the secondary transferring unit where the complex transfer image is transferred onto the recording medium is preferable.

The intermediate transfer member is not particularly limited, and it can be optionally selected from heretofore known transferring members depending on the purpose. It favorably includes, for example, a transfer belt.

It is preferable that the transferring unit (the primary transferring unit and the secondary transferring unit) comprises a transferring section which releases and charges the visible image formed on the latent image bearing member onto the recording medium. The transferring unit may be one, or it may be two or more.

Examples of the transferring section include a corona transferring section by corona discharge, a transfer belt, a transfer roller, pressure transfer roller and a tacky transferring section.

The recording medium is typified by plain paper, but it is not particularly limited as long as an unfixed image after the development can be transferred. It can be optionally selected depending on the purpose, and a PET base for OHPs and the like can be used.

—Fixing Process and Fixing Unit—

The fixing process is a process of fixing the visible image transferred onto the recording medium using a fixing apparatus. It may be performed at every transfer of each color-toner onto the recording medium, or it may be performed all together simultaneously for respective color toners in a laminated state.

The fixing apparatus is not particularly limited, and it can be optionally selected depending on the purpose. A heating and pressurizing unit heretofore known is preferable. The heating and pressurizing unit includes a combination of a heating roller and a pressurizing roller, and a combination of the heating roller, the pressurizing roller and an endless belt.

A typical heating temperature in the heating and pressurizing unit is preferably 80° C. to 200° C.

In the present invention, depending on the purpose, a heretofore known optical fixing section may be used along with or in place of the fixing process The neutralizing process is a process of applying a neutralization bias to the latent image bearing member to neutralize, and it can be suitably performed by the neutralizing unit.

The neutralizing unit is not particularly limited as long as the neutralization bias can be applied to the latent image bearing member, and it can be optionally selected from publicly known neutralizing sections. Suitable examples include a neutralizing lamp.

The cleaning process is a process of removing the electrographic toner left on the latent image bearing member, and it can be suitably performed by the cleaning unit.

The cleaning unit is not particularly limited as long as the electrographic toner left on the latent image bearing member can be removed, and it can be optionally selected from heretofore known cleaners. Suitable examples include magnetic cleaners, electrostatic brush cleaners, magnetic roller cleaners, blade cleaners, brush cleaners and web cleaners.

The recycling process is a process of recycling the toner for the electrograph removed in the cleaning process to the developing unit, and it can be suitably performed by the recycling unit.

The recycling unit is not particularly limited, and examples include heretofore known feeding units.

The controlling unit is a process of controlling the above respective steps, and it can be suitably performed by the controlling unit.

The controlling unit is not particularly limited as long as the movement of each unit can be controlled, and it can be optionally selected depending on the purpose. Examples include instruments such as sequencers and computers.

Subsequently, one aspect where the image forming method of the present invention is carried out using the image forming apparatus of the present invention is described with reference to FIG. 2. The image forming apparatus 100 comprises a photoconductor drum 10 (hereinafter referred to as a 'photoconductor 10') as the latent image bearing member, a charging roller 20 as the charging unit, an exposure apparatus 30 as the exposing unit, a developing section 40 as the developing unit, an intermediate transfer member 50, a cleaning apparatus 60 as the cleaning unit having a cleaning blade, and a neutralizing lamp 70 as the neutralizing unit.

The intermediate transfer member 50 is an endless belt, and it is designed such that it moves in the arrow direction by three rollers 51 which are disposed inside the belt and extend the belt. A part of the three rollers 51 works as a transfer bias roller capable of applying a given transfer bias (primary transfer bias) to the intermediate transfer member 50. A cleaning apparatus 90 having a cleaning blade is disposed in the vicinity of the intermediate transfer member 50, and a transfer roller 80 as the transferring unit capable of applying the transfer bias for transferring (secondary transfer) the developed image (toner image) to transfer paper 95 as the final recording medium is disposed in opposition to the intermediate transfer member 50. Around the intermediate transfer member 50A, corona charging section 58 for electrically charging the toner image on the intermediate transfer member 50 is disposed in the rotating direction of the intermediate transfer member 50, between a contact portion of the photoconductor 10 with the intermediate transfer member 50 and a contact portion of the intermediate transfer member 50 with the transfer paper 95.

A developing section 40 is composed of a developing belt 41 as the developer bearing member, and a black development unit 45K, a yellow development unit 45Y, a magenta development unit 45 M and a cyan development unit 45C installed side by side in the periphery of the developing belt 41. The black development unit 45K comprises a developer container 42K, a developer supply roller 43K and a developing roller 44K. The yellow development unit 45Y comprises a developer container 42Y, a developer supply roller 43Y and a developing roller 44Y. The magenta development unit 45M comprises a developer container 42M, a developer supply roller 43M and a developing roller 44M. The cyan development unit 45C comprises a developer container 42C, a developer supply roller 43C and a developing roller 44C. The developing belt 41 is the endless belt, ant it is rotatably extended over multiple belt rollers. A part thereof is contacted with the photoconductor 10.

Figure 2:
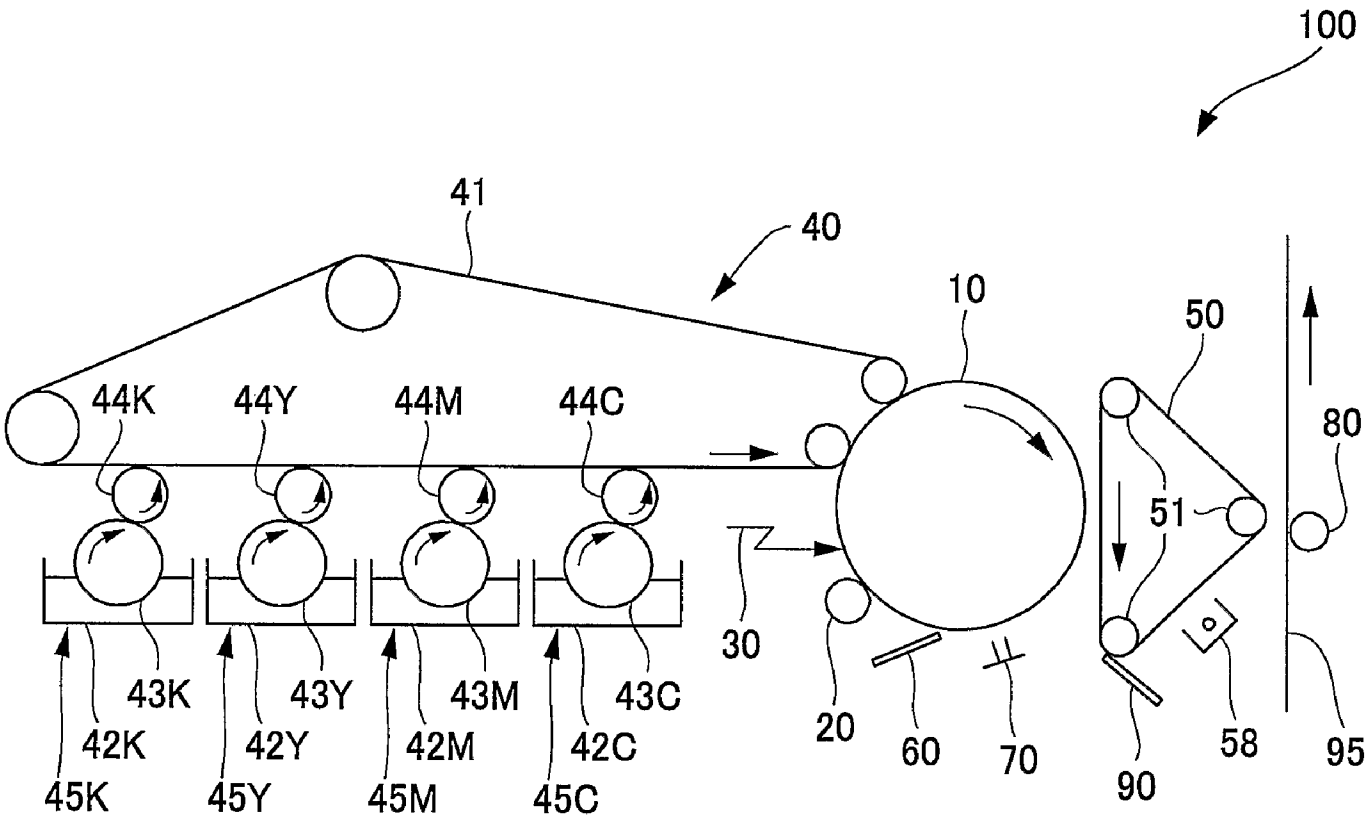
FIG. 2 is a schematic diagram showing one example of an image forming apparatus of the present invention.

In the image forming apparatus shown in FIG. 2, for example, the charging roller 20 uniformly charges the photoconductor drum 10. The exposing apparatus 30 exposes the photoconductor drum 10 according to the image to form the latent electrostatic image. The latent electrostatic image formed on the photoconductor drum 10 is developed using the toner supplied from the developing section 40 to form a toner image. The toner image is transferred (primary transfer) onto the intermediate transfer member 50 and further transferred (secondary transfer) onto the transfer paper 95 by the voltage applied by the rollers 51. As a result, a transfer image is formed on the transfer paper 95. The toner left on the photoconductor 10 is removed by the cleaning apparatus 60, and the charge on the photoconductor 10 is once removed by the neutralizing lamp 70.

Figure 3:
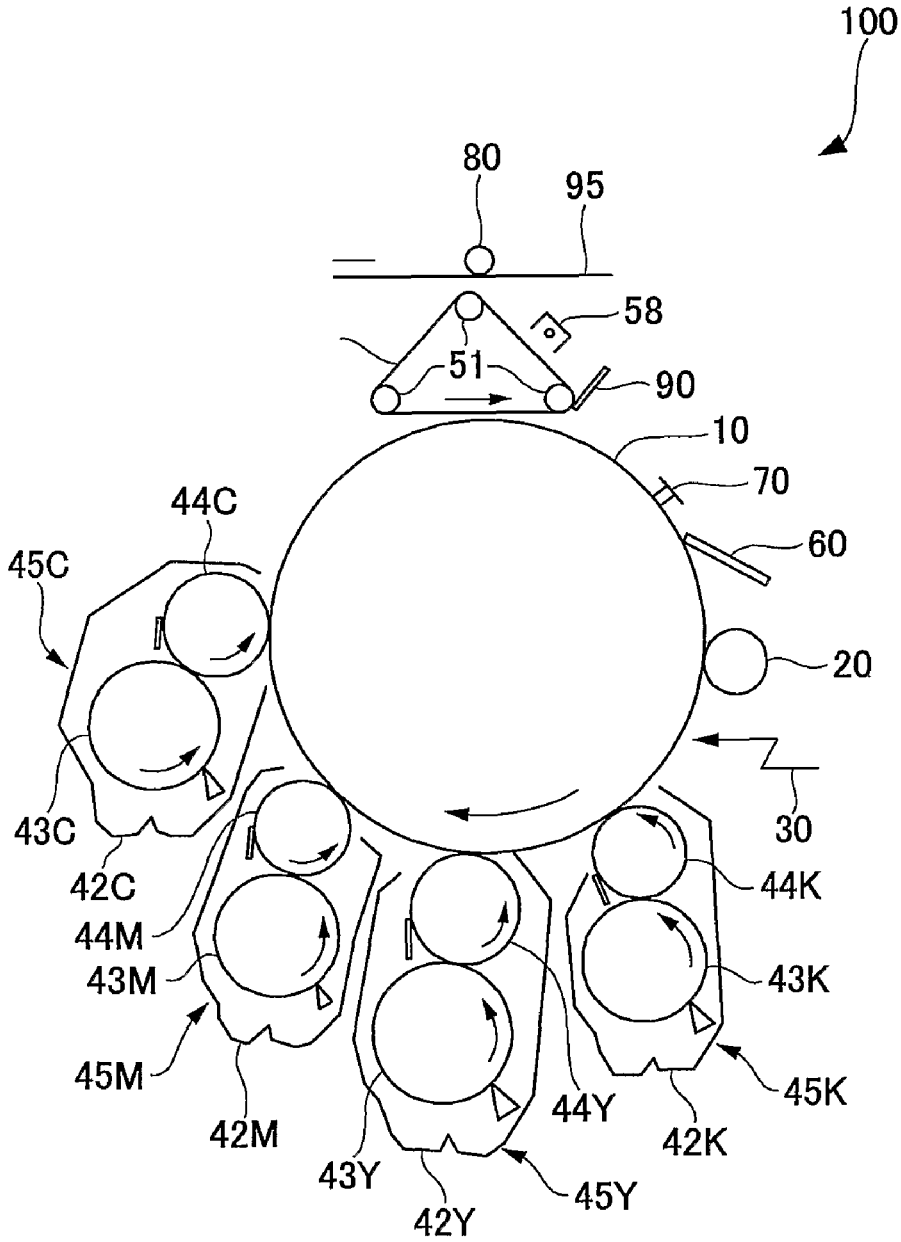
FIG. 3 is a schematic diagram showing another example of an image forming apparatus of the present invention.

Another aspect where the image forming method of the present invention is carried out by the image forming apparatus of the present invention is described with reference to FIG. 3. The image forming apparatus 100 shown in FIG. 3 has the same constitution and the same action effects as the image forming apparatus 100 shown in FIG. 2, except that the developing belt 41 is not comprised and that the black development unit 45K, the yellow development unit 45Y, the magenta development unit 45M and the cyan development unit 45C are disposed directly opposite to the photoconductor 10 in the periphery thereof. The parts in FIG. 3 which is equivalent to those in FIG. 3 are identified by the same symbols.

Figure 4:
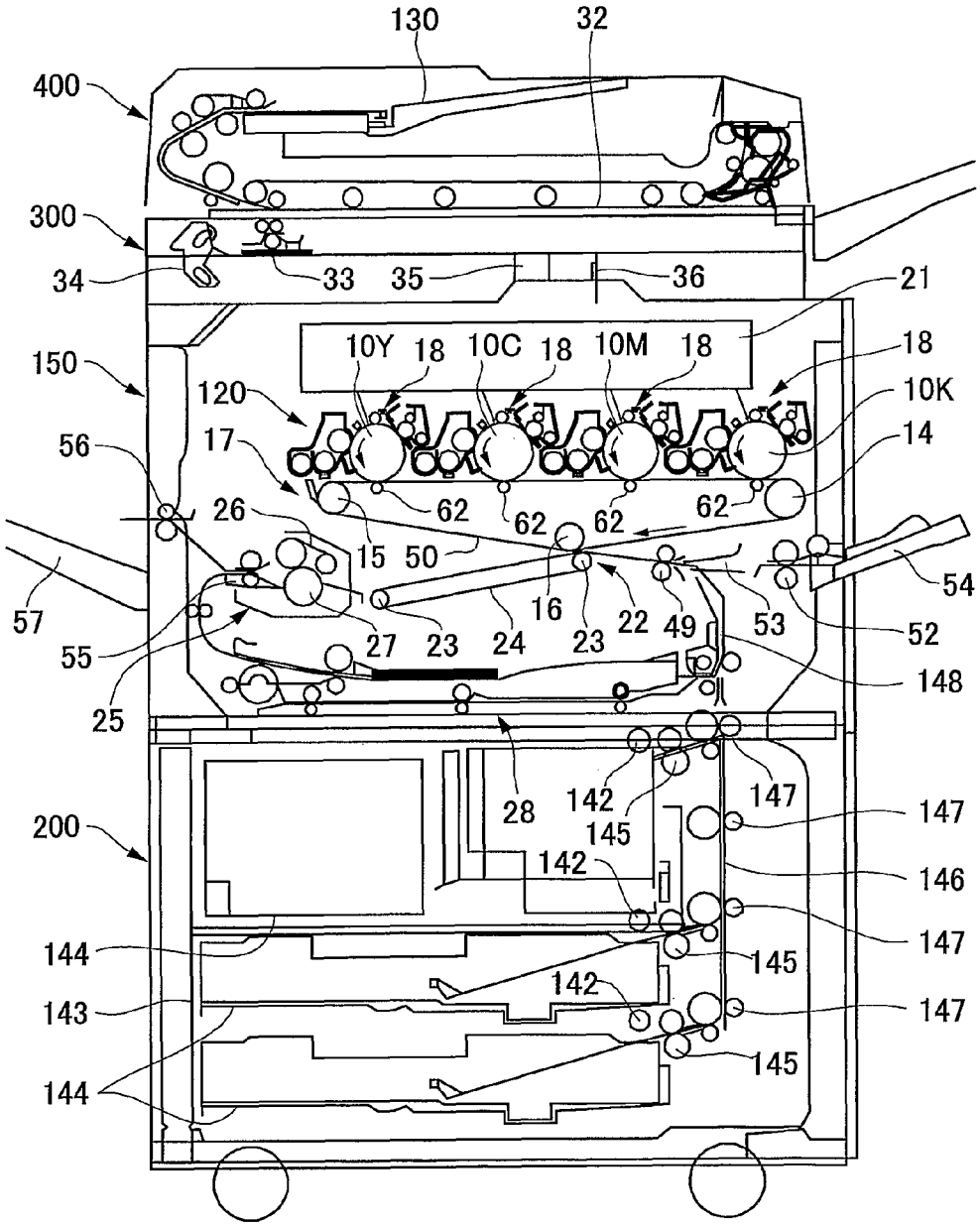
FIG. 4 is a schematic diagram showing one example of a tandem type image forming apparatus of the present invention.

Another aspect where the image forming method of the present invention is carried out by the image forming apparatus of the present invention is described with reference to FIG. 4. A tandem image forming apparatus 100 shown in FIG. 4 is a tandem color image forming apparatus. The tandem image forming apparatus 120 comprises a main body 150 of the copying apparatus, a paper supply table 200, a scanner 300 and an automatic document feeder (ADF) 400.

The intermediate transfer member 50 in the form of an endless belt is provided at the center of the main body 150. The intermediate transfer member 50 is extended over support rollers 14, 15 and 16, and it can be rotated clockwise in FIG. 4. An intermediate transferring member cleaning apparatus 17 for removing the toner left on the intermediate transferring member 50 is disposed in the vicinity of the support roller 15. A tandem developing section 120 where four image forming units 18 of yellow, cyan, magenta and black are arranged side by side at an opposite side to the intermediate transferring member 50 is disposed along the feeding direction of the intermediate transferring member 50 extended by the support rollers 14 and 15. The exposure apparatus 21 is disposed in the vicinity of the tandem developing section 120. A secondary transferring apparatus 22 is disposed on the opposite side of the tandem developing section 120. In the secondary transferring apparatus 22, a secondary transfer belt 24, an endless belt, extended over a pair of rollers 23, and the transfer paper fed on the secondary transfer belt 24 and the intermediate transferring member 50 can be contacted one another. A fixing apparatus 25 is disposed in the vicinity of the secondary transferring apparatus 22.

In the tandem image forming apparatus 100, a sheet reversing apparatus 28 for reversing a transfer paper in order to forming images on both sides of the transfer paper is disposed in the vicinity of the secondary transferring apparatus 22 and the fixing apparatus 25.

Subsequently, the formation of a full-color image (color copy) using the tandem developing section 120 is described. First, a document is set on a document table 130 in the automatic document feeder (ADF) 400, or the automatic document feeder 400 is opened. A document is set on a contact glass 32 of the scanner 300, and the automatic document feeder 400 is closed.

When a start button (not shown in the figure) is pressed, the scanner 300 drives, and a first carriage 33 and a second carriage 34 run after the document is fed and moved onto the contact glass 32 in the case the document has been set in the automatic document feeder 400, or immediately in the case the document has been set on the contact glass 32. Here, a light is applied from a light source through the first carriage 33, and simultaneously the light reflected from the document surface is reflected by a mirror in the second carriage 34. A color document (color image) is read out from the light received in a reading sensor 36 through an image forming lens 35 to produce image information of black, yellow, magenta and cyan.

Figure 5:
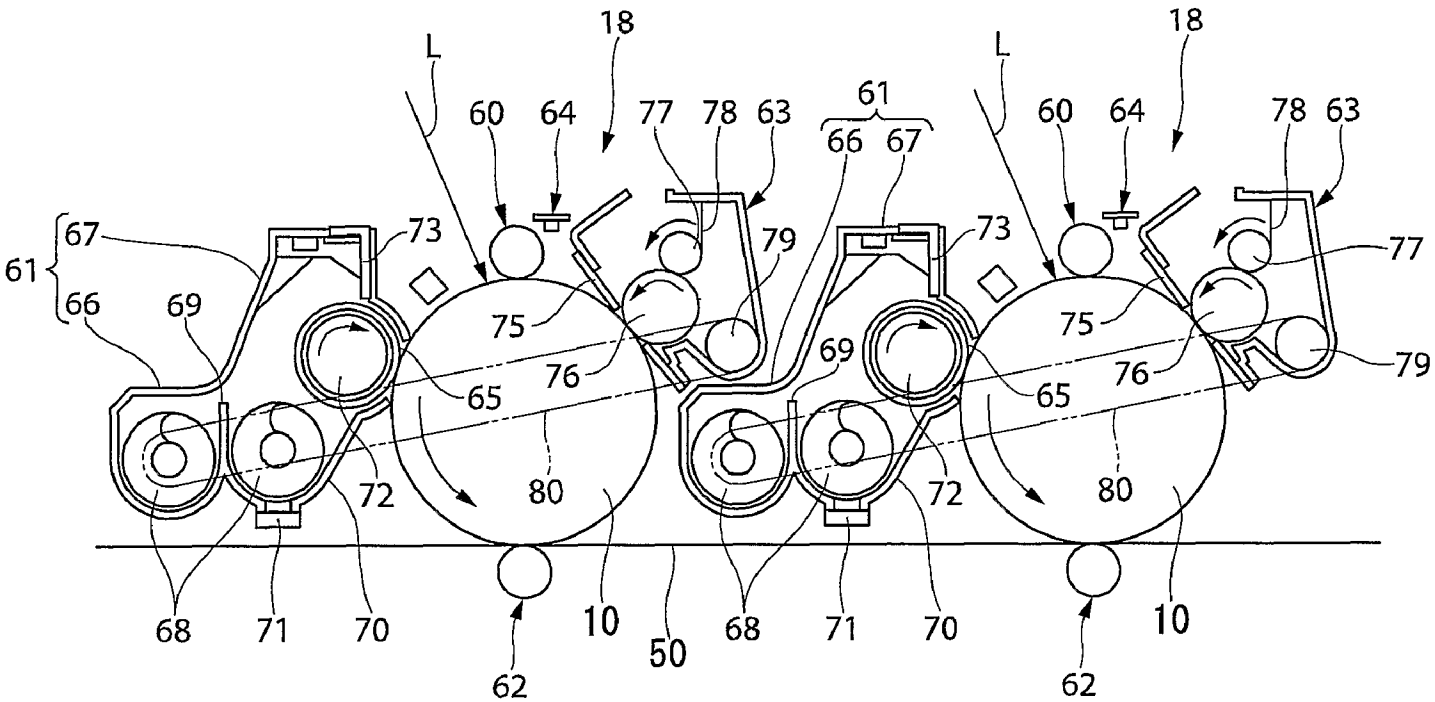
FIG. 5 is a partially enlarged view of FIG. 4.

Each image information of black, yellow, magenta and cyan is communicated to each image forming unit 18 (image forming unit for black, image forming unit for yellow, image forming unit for magenta and image forming unit for cyan) in the tandem developing section 120, and in each image forming unit, each of toner images of black, yellow, magenta and cyan is formed. That is, each image forming unit 18 (image forming unit for black, image forming unit for yellow, image forming unit for magenta and image forming unit for cyan) in the tandem developing section 120 comprises the following: the photoconductor 10 (photoconductor for black 10K, photoconductor for yellow 10Y, photoconductor for magenta 10M and photoconductor for cyan 10C); the charging section 60 which uniformly charges the photoconductor; the exposing section which exposes (L in FIG. 5) the photoconductor according to the image corresponding to each color image based on each color image information and forms a latent electrostatic image corresponding to each color image on the photoconductor; the developing section 61 which develops the latent electrostatic image using each color toner (black toner, yellow toner, magenta toner and cyan toner) to form a toner image by each color toner; the transferring and charging section 62 for transferring the toner image onto the intermediate transferring member 50; the photoconductor cleaning apparatus 63; and the neutralizing section 64. Each image forming unit 18 can form an image of each single color (black image, yellow image, magenta image and cyan image) based on each color image information. The black image, the yellow image, the magenta image and the cyan image formed in this way are delivered to the intermediate transferring member 50 rotated by the support rollers 14, 15 and 16, and the black image formed on the photoconductor for black 10K, the yellow image formed on the photoconductor for yellow 10Y, the magenta image formed on the photoconductor for magenta 10M and the cyan image formed on the photoconductor for cyan 10C are sequentially transferred onto the intermediate transferring member 50 (primary transfer). Then, a composite color image (color transfer image) is formed on the intermediate transferring member 50 by superimposing the black image, the yellow image, the magenta image and the cyan image.

Meanwhile, in the paper supply table 200, one of paper supply rollers 142 is selectively rotated to supply a sheet (recording paper) from one of multiple paper supply cassettes 144 provided in a paper bank 143. The sheet is separated by a separation roller 145 and fed to a paper supply path 146. It is then delivered by a feeding roller 147 to a paper supply path 148 in the main body 150 and stopped by hitting a resist roller 49. Alternatively, the sheet (recording paper) on a manual paper feeding tray 54 is supplied by rotating the paper supply roller 142, is separated by one by a separation roller 52 to place in a manual paper feeding paper supply path 53 and is also stopped by hitting the resist roller 49. The resist roller 49 is generally used grounded, but it may be used in a bias-applied state for removing paper powder on the sheet. Then, a color image is transferred and formed on the sheet (recording paper) by rotating the resist roller 49 at the same timing as the composite color image made on the intermediate transferring member 50, which sends out the sheet between the intermediate transferring member 50 and the secondary transferring apparatus 22 and transfers the composite color image (color transfer image) onto the sheet (recording paper) by the secondary transferring apparatus 22. The toner left on the intermediate transferring member 50 after transferring the image is cleaned by an intermediate transferring member cleaning apparatus 17.

The sheet (recording paper) on which the color image has been transferred and formed is delivered by the secondary transferring apparatus 22 and sent to the fixing apparatus 25, and the composite color image (color transfer image) is fixed on the sheet (recording paper) with heat and pressure in the fixing apparatus 25. Subsequently, the sheet (recording paper) is switched by a switch blade 55, discharged by a discharging roller 56 and stacked on a catch tray 57. Alternatively, the sheet is switched at a switch blade 55 and reversed by a reversing apparatus 28 to lead again to a transfer position, and an image is also recorded on a backside. Then, the sheet is discharged by the discharging roller 56 and stacked on the catch tray 57

Figure 11:
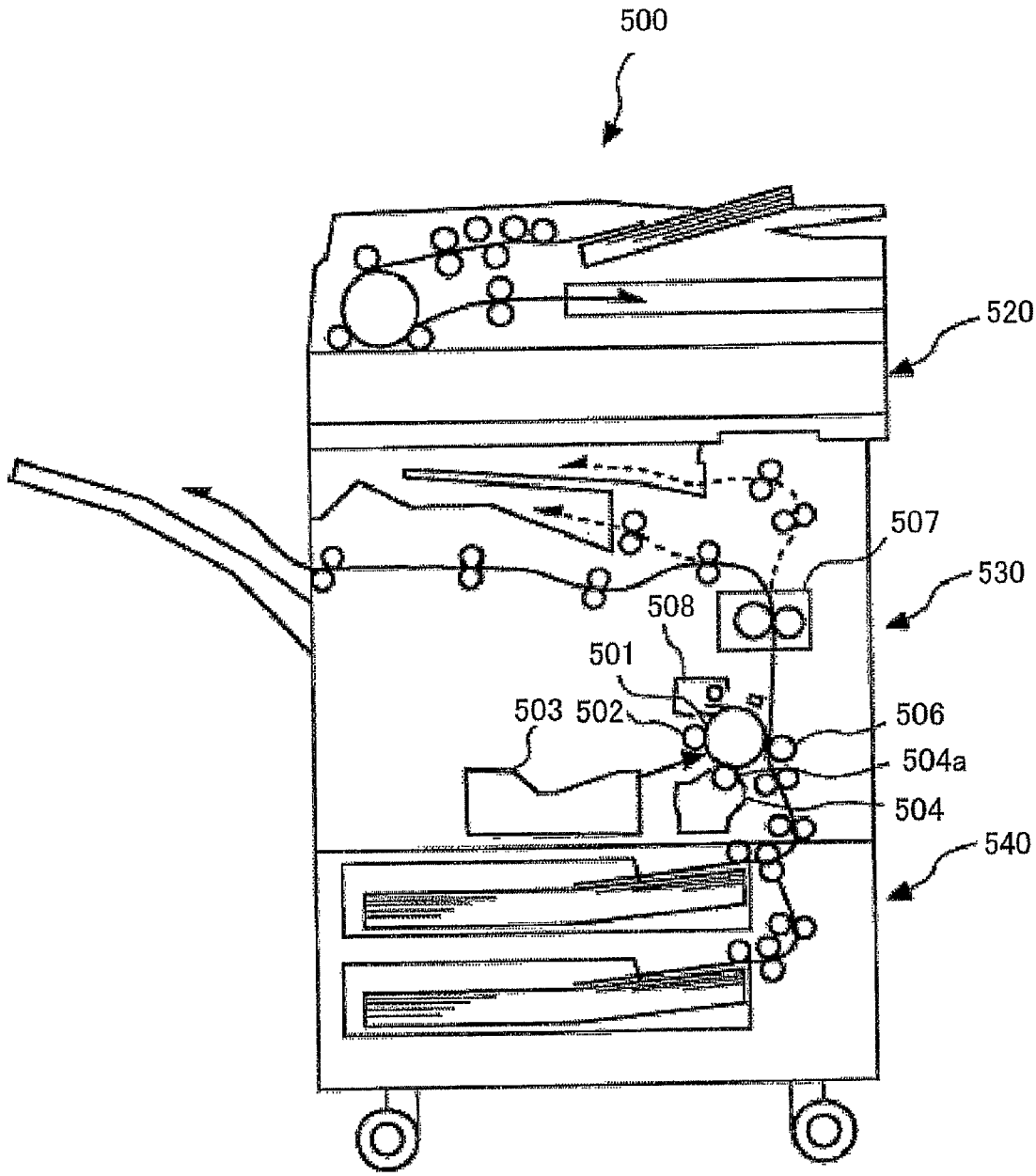
FIG. 11 is a schematic diagram showing another example of an image forming apparatus of the present invention.

FIG. 11 is a schematic diagram showing one example of the image forming apparatus according to the present invention. The image forming apparatus 500 comprises a document reading part 520, an image forming part 530 and a paper supply part 540. In the image forming part 530, a photoconductor 501 which is the latent image bearing member, a charging unit 502, an exposing unit 503, a developing unit 504, a transferring unit 506, a fixing unit 507 and a cleaning unit 508 in the periphery of the photoconductor 501 are disposed. The surface of the photoconductor 501 is uniformly charged by the charging unit 502, and then the latent electrostatic image is formed on the charged surface by exposure light of the exposing unit 503. The developer comprising the toner having the same polarity as the polarity of the formed latent image is supplied by the developing unit 504 to develop the latent image, which is then transferred to a delivered recording member such as paper by the transferring unit 506. The recording member is subsequently delivered to the fixing unit 507, and the toner is fixed on the recording member with heat and pressure. Meanwhile, the toner left on the photoconductor 501 after transferring is removed by the cleaning unit 508.

The developer comprising the toner is used for the developing unit 504. In the developing unit 504, a developer bearing member 504*a* bears and delivers the developer, and the latent image on the photoconductor 501 is developed by applying the alternating electric field at an opposite position to the photoconductor 501. By applying the alternating electric field, it is possible to activate the developer, to narrow the charge distribution of the toner and to enhance the developing property.

In accordance with the present invention, by finely controlling the surface characteristics of the toner base particles, it is possible to provide a toner and a developer which form a high quality image, simultaneously satisfying the discharging property, the developing property and the transfer property even when the toner which is excellent in dot reproducibility is minimized in particle size and made spherical. In addition, a high-quality image with favorable cleaning stability over time, charge stability, developing property and transfer property as well as excellent reproducibility of fine dots may be provided by employing the image forming apparatus comprising the developer with the toner of the present invention.

The present invention will be further described with reference to the following examples, but these are not to be construed the present invention. Hereinafter, 'part' and '%' represent part by mass and % by mass, respectively.

For a magnetic carrier used for a two-component developer, the followings were used, which were common to respective Examples.

<Production of Magnetic Carrier>

| | |
|---|---|
| Cu—Zn ferrite particles as a core material with a weight average diameter of 35 μm | 5,000 parts |
| -Coating materials- | |
| Toluene | 450 parts |
| Silicone resin SR2400 (manufactured by Dow Corning Toray Co., Ltd. with non-volatile content of 50%) | 450 parts |
| Aminosilane SH6020 (manufactured by Dow Corning Toray Co., Ltd.) | 10 parts |
| Carbon black | 10 parts |

The above coating materials were dispersed with a stirrer for 10 minutes to prepare a coating solution, and this coating solution and the core material were placed in a coating apparatus in which a rotary base-plate disc and mixing blades had been provided in a fluidized bed. The coating was performed by generating a spiral flow to apply the coating solution on the core material. The resulting coated material was calcined in an electric furnace at 250° C. for two hours to obtain a carrier coated with the silicone resin having an average thickness of 0.5 μm.

—Production of Two-Component Developer—

The developer was produced by uniformly mixing seven parts of each color toner shown in the following Examples to 100 parts of the carrier using a tumbler mixer in which the stirring was performed by rolling a container, followed by charging.

Example 1

Synthesis of Organic Particulate Emulsion

In a reaction vessel equipped with a stirring bar and a thermometer, 683 parts of water, 11 parts of sodium salt of methacrylic acid ethylene oxide adduct sulfate ester (Eleminol RS-30, manufactured by Sanyo Chemical Industries Ltd.), 83 parts of styrene, 83 parts of methacrylic acid, 110 parts of butyl acrylate and two parts of ammonium persulfate were placed, and the mixture was stirred at 4,200 rpm for 60 minutes to obtain a white emulsion. This was heated until the temperature in the system was 75° C. and reacted for four hours. Further, 30 parts of an aqueous solution of 1% ammonium persulfate was added, and the mixture was aged at 75° C. for six hours to yield an aqueous emulsion (particulate emulsion 1) of a vinyl based resin (copolymer of styrene-methacrylic acid-butyl acrylate-sodium salt of methacrylic acid ethylene oxide adduct sulfate ester).

The volume average particle diameter of the resulting particulate emulsion 1, measured with a laser diffraction/scattering particle size distribution measurement apparatus (LA-920, manufactured by Horiba Seisakusho), was 50 nm. A resin content was isolated by drying a part of the particulate emulsion 1. The glass transition temperature (Tg) and the weight average molecular weight of the resin content were 51° C. and 110,000, respectively.

—Preparation of Aqueous Phase—

A creamy white liquid was obtained by mixing and stirring 990 parts of water, 83 parts of particulate emulsion 1, 37 parts of an aqueous solution of 48.3% of sodium dodecyldiphenyletherdisulfonate (Eleminol MON-7, manufactured by Sanyo Chemical Industries Ltd.) and 90 parts of ethyl acetate. This is rendered an aqueous phase 1.

—Synthesis of Low Molecular Polyester—

In a reaction vessel equipped with a cooling tube, a stirrer and a nitrogen introducing tube, 724 parts of bisphenol A ethylene oxide 2 mole adduct and 276 parts of terephthalic acid were placed for polycondensation at 230° C. under normal pressure for seven hours and further reacted under reduced pressure of 10 mmHg to 15 mmHg for five hours to yield a low-molecular polyester 1. The resulting low-molecular polyester 1 exhibited a number average molecular weight of 2,300, the weight average molecular weight of 6,700, a peak molecular weight of 3,800, a glass transition temperature (Tg) of 43° C. and an acid value of four.

—Synthesis of Intermediate Polyester (Prepolymer)—

In a reaction vessel equipped with a cooling tube, a stirrer and a nitrogen introducing tube, 682 parts of bisphenol A ethylene oxide 2 mole adduct, 81 parts of bisphenol A propylene oxide 2 mole adduct, 283 parts of terephthalic acid, 22 parts of trimellitic acid anhydrate and two parts of dibutyltin oxide were added, reacted at 230° C. under normal pressure for seven hours and further reacted under reduced pressure of 10 mmHg to 15 mmHg for five hours to yield an intermediate polyester 1.

The resulting intermediate polyester 1 exhibited a number average molecular weight of 2,200, a weight average molecular weight of 9,700, a peak molecular weight of 3,000, a glass transition temperature (Tg) of 54° C., an acid value of 0.5 and a hydroxyl value of 52.

Subsequently, in a reaction vessel equipped with a cooling tube, a stirrer and a nitrogen introducing tube, 410 parts of the intermediate polyester 1, 89 parts of isophorone diisocyanate and 500 parts of ethyl acetate were placed and reacted at 100° C. for five hours to yield a prepolymer 1. The mass fraction of the free isocyanate was 1.53% by mass in the prepolymer 1.

—Synthesis of Ketimine—

In a reaction vessel equipped with a stirring bar and a thermometer, 170 parts of isophorone diamine and 75 parts of methyl ethyl ketone were added and reacted at 50° C. for 4.5 hours to yield a ketimine compound 1. An amine value of the ketimine compound 1 was 417.

—Synthesis of Master Batch—

A master batch 1 was obtained by mixing 1,200 parts of water, 540 parts of carbon black (Printex 35, manufactured by Degussa AG with DBP oil absorption amount of 42 mL/100 mg and pH of 9.5) and 1,200 parts of a polyester resin with a Henschel mixer (Mitsui Mining Co., Ltd.). The mixture was kneaded using two rolls at 130° C. for one hour, which was then rolled, cooled and pulverized in a pulverizer.

—Production of Oil Phase—

In a reaction vessel equipped with a stirring bar and a thermometer, 378 parts of the low molecular polyester 1, 100 parts of carnauba wax and 947 parts of ethyl acetate were placed. The vessel was heated to 80° C. with stirring, which was maintained at 80° C. for five 25 hours. The vessel was subsequently cooled to 30° C. over one hour. Then, 500 parts of the master batch 1 and 500 parts of ethyl acetate were added to the vessel, and it was mixed for one hour to yield a raw material solution 1.

Subsequently, 1,324 parts of the raw material solution 1 was transferred into a vessel, and carbon black and wax were dispersed using a bead mill (Ultraviscomill, manufactured by IMEX Corporation) under a condition with a solution sending rate of 1 kg/hr, a disc peripheral speed of 6 m/sec, 0.5-mm zirconia beads packed at 80% by volume and three passes. Then, 1,324 parts of an ethyl acetate solution of 65% low molecular polyester 1 was added, and two passes by the bead mill under the above condition was given thereto to yield a pigment/wax dispersion 1. The concentration of the solid content of the pigment/wax dispersion 1 was 50%.

A composition obtained by adding 20 parts of inorganic particulates (Organosilica sol MEK-ST-UP with an ER of 20%, manufactured by Nissan Chemical Industries, Ltd.) to 100 parts of the above pigment/wax dispersion 1 and mixing by the TK homomixer with a rotational frequency of 7,000 rpm and a temperature of 25° C. for 10 minutes to give a pigment/wax/inorganic particulate dispersion 1. It is preferable to use the dispersion for emulsification within eight weeks from the preparation thereof. After this period, the inorganic particulates are aggregated again to make the shape control impossible.

—Emulsification to Desolvation—

In a vessel, 749 parts of the pigment/wax/inorganic particulate dispersion 1, 115 parts of the prepolymer 1 and 2.9 parts of the ketimine compound 1 were placed and mixed using a TK homomixer (manufactured by Tokushu Kika Kogyo Co., Ltd.) at 5,000 rpm for two minutes. Subsequently, 1,200 parts of the aqueous phase 1 was added to the vessel and mixed using the TK homomixer at a rotational frequency of 13,000 rpm for 25 minutes to yield an emulsified slurry 1

In a vessel equipped with a stirrer and a thermometer, the emulsified slurry 1 was added for desolvation at 30° C. for seven hours. The vessel was aged at 45° C. for seven hours to yield a dispersed slurry 1.

—Washing to Drying—

After 100 parts of the dispersed slurry 1 was filtrated under reduced pressure, the filtrate was washed as follows:

(i) One hundred (100) parts of ion-exchange water was added to the filter cake, mixed using the TK homomixer at a rotational frequency of 12,000 rpm for 10 minutes and subsequently filtered.

(ii) One hundred (100) parts of an aqueous solution of 10% sodium hydroxide was added to the filter cake of (i), mixed using the TK homomixer at a rotational frequency of 12,000 rpm for 10 minutes and subsequently filtered under reduced pressure.

(iii) One hundred (100) parts of 10% hydrochloric acid was added to the filter cake of (ii), mixed using the TK homomixer at a rotational frequency of 12,000 rpm for 10 minutes and subsequently filtered.

(iv) Three hundred (300) parts of ion-exchange water was added to the filter cake of (iii), mixed using the TK homomixer at a rotational frequency of 12,000 rpm for 10 minutes and subsequently filtered. These operations were repeated once to yield a filter cake 1.

The resulting filter cake 1 was dried in a circular wind dryer at 45° C. for 48 hours, and sieved with a mesh having 75 μm openings to yield toner base particles 1. Subsequently, one part of hydrophobic silica and one part of hydrophobic titanium oxide were mixed with 100 parts of the toner base particles 1 using the Henschel mixer to yield a toner.

Example 2

A toner was obtained in the same manner as Example 1 except that the conditions in Example 1 were changed as follows:

—Production of Oil Phase—

In a reaction vessel equipped with a stirring bar and a thermometer; 378 parts of the low molecular polyester 1, 100 parts of carnauba wax and 947 parts of ethyl acetate were placed, heated to 80° C. with stirring, maintained at 80° C. for five hours and subsequently cooled to 30° C. over one hour. Then, 500 parts of the master batch 1 and 500 parts of ethyl acetate were added to the vessel and mixed for one hour to yield the raw material solution 1.

Subsequently, 1,324 parts of the raw material solution 1 was transferred into a vessel, and carbon black and wax were dispersed using the bead mill (Ultraviscomill, manufactured by IMEX Corporation) under the condition of a solution sending rate of 1 kg/hr, a disc peripheral speed of 6 m/sec, 0.5-mm zirconia beads packed at 80% by volume and three passes. Then, 1,324 parts of an ethyl acetate solution of 65% low molecular polyester 1 was added and two passes by the bead mill under the above condition was given thereto to yield a pigment/wax dispersion 2. A solid content concentration of the pigment/wax dispersion 1 was 50%.

A composition obtained by adding 30 parts of inorganic particulates (Organosilica sol MEK-ST-UP with an ER of 20%, manufactured by Nissan Chemical Industries, Ltd.) to 100 parts of the above pigment/wax dispersion 2 and mixing with the TK homomixer with a rotational frequency of 7,000 rpm and a temperature of 25° C. for 13 minutes was rendered a pigment/wax/inorganic particulate dispersion 2. It is desirable to use the dispersion for emulsification within eight weeks from the preparation thereof. After this period, the inorganic particulates are aggregated again to make the shape control impossible.

Example 3

A toner was obtained in the same manner as Example 1 except that the conditions in Example 1 were changed as follows:

—Emulsification to Desolvation—

In a vessel, 749 parts of the pigment/wax/inorganic particulate emulsion 1, 115 parts of the prepolymer 1 and 2.9 parts of the ketimine compound 1 were placed and mixed using a TK homomixer (manufactured by Tokushu Kika Kogyo Co., Ltd.) at 5,000 rpm for two minutes. Subsequently, 1,200 parts of the aqueous phase 1 was added to the vessel and mixed using the TK homomixer at a rotational frequency of 10,000 rpm for 10 minutes to yield an emulsified slurry 2.

In a vessel equipped with a stirrer and a thermometer, the emulsified slurry 2 was added for desolvation at 30° C. for six hours which was aged at 45° C. for five hours to yield a dispersed slurry 2.

Example 4

A toner was obtained in the same manner as Example 1 except that the process of emulsification to desolvation was changed as follows.

—Emulsification to Desolvation—

In a vessel, 749 parts of the pigment/wax/inorganic particulate emulsion 1, 115 parts of the prepolymer 1 and 2.9 parts of the ketimine compound 1 were placed and mixed using a TK homomixer (manufactured by Tokushu Kika Kogyo Co., Ltd.) at 5,000 rpm for two minutes. Subsequently, 1,200 parts of the aqueous phase 1 was added to the vessel and mixed using the TK homomixer at a rotational frequency of 10,000 rpm for 40 minutes to yield an emulsified slurry 3.

In a vessel equipped with a stirrer and a thermometer, the emulsified slurry 3 was added for desolvation at a temperature of 30° C. for eight hours, which was aged at 45° C. for five hours to yield a dispersed slurry 3

Example 5

A toner was obtained in the same manner as Example 1, except that the conditions were changed as follows. Physical properties and evaluation results of the resulting toner 5 are shown in Table 1 and Table 2, respectively.

—Production of Oil Phase—

In a reaction vessel equipped with a stirring bar and a thermometer, 378 parts of the low molecular polyester 1, 130 parts of carnauba wax/rice wax (mass ratio of 5/5) and 947 parts of ethyl acetate were placed and heated to 80° C. with stirring, maintained at 80° C. for four hours and subsequently cooled to 30° C. over one hour. Then, 500 parts of the master batch 1 and 500 parts of ethyl acetate were added to the vessel and mixed for two hours to yield a raw material solution 2.

Subsequently, 1,324 parts of the raw material solution 2 was transferred into a vessel, and carbon black and wax were dispersed using the bead mill (Ultraviscomill, manufactured by IMEX Corporation) under the condition of a solution sending rate of 1 kg/hr, a disc peripheral speed of 6 m/sec, 0.5-mm zirconia beads filled at 80% by volume and 10 passes. Then, 1,324 parts of an ethyl acetate solution of 65% low molecular polyester 1 was added, and 6 passes by the bead mill under the above condition was given thereto to yield a pigment/wax dispersion 3. A solid content concentration of the pigment/wax dispersion 3 was 50%.

A composition obtained by adding 20 parts of inorganic particulates (Organosilica sol MEK-ST-UP with an ER of 20%, manufactured by Nissan Chemical Industries, Ltd.) to 100 parts of the above pigment/wax dispersion 3 and mixing by a TK homomixer with a rotational frequency of 7,000 rpm and a temperature of 25° C. for 10 minutes was rendered a pigment/wax/inorganic particulate emulsion 3. It is desirable to use the dispersion for emulsification within eight weeks from the preparation thereof. After this period, the inorganic particulates are aggregated again to make the shape control impossible.

Example 6

A toner was obtained in the same manner as Example 1, except that the conditions were changed as follows.

—Production of Oil Phase—

In a reaction vessel equipped with a stirring bar and a thermometer, 378 parts of the low molecular polyester 1, 100 parts of carnauba wax/rice wax (mass ratio of 3/7) and 947 parts of ethyl acetate were placed and heated to 80° C. with stirring, maintained at 80° C. for four hours and subsequently cooled to 30° C. over one hour. Then, 500 parts of the master batch 1 and 500 parts of ethyl acetate were added to the vessel and mixed for 0.8 hours to yield a raw material solution 3.

Subsequently, 1,324 parts of the raw material solution 3 was transferred to a vessel, and carbon black and waxes were dispersed using the bead mill (Ultraviscomill, manufactured by IMEX Corporation) under the condition of a solution sending rate of 1 kg/hr, a disc peripheral speed of 6 m/sec, 0.5-mm zirconia beads packed at 80% by volume and five passes. Then, 1,324 parts of an ethyl acetate solution of 65% low molecular polyester 1 was added and three passes by the bead mill under the above condition was given thereto to yield a pigment/wax dispersion 4. The concentration of the solid content of the pigment/wax dispersion 4 was 50%.

The composition obtained by adding 20 parts of inorganic particulates (Organosilica sol MEK-ST-UP with an ER of 20%, manufactured by Nissan Chemical Industries, Ltd.) to 100 parts of the above pigment/wax dispersion 4 and mixing by the TK homomixer at a rotational frequency of 7,000 rpm and a temperature of 25° C. for 10 minutes was rendered a pigment/wax/inorganic particulate dispersion 4. It is desirable to use the dispersion for emulsification within eight weeks from the preparation thereof. After this period, the inorganic particulates are aggregated again to make the shape control impossible.

Example 7

A toner was obtained in the same manner as Example 1 except that the conditions were changed as follows:

—Production of Oil Phase—

In a reaction vessel equipped with a stirring bar and a thermometer, 378 parts of the low molecular polyester 1, 380 parts of carnauba wax and 947 parts of ethyl acetate were placed, heated to 80° C. with stirring, maintained at 80° C. for four hours, and subsequently cooled to 30° C. over one hour. Then, 500 parts of the master batch 1 and 500 parts of ethyl acetate were added to the vessel and mixed for two hours to yield a raw material solution 5.

Subsequently, 1,324 parts of the raw material solution 5 was transferred to a vessel, and carbon black and waxes were dispersed using the bead mill (Ultraviscomill, manufactured by IMEX Corporation) under the condition of a solution sending rate of 1 kg/hr, a disc peripheral speed of 6 m/sec, 0.5-mm zirconia beads packed at 80% by volume and seven passes. Then, 1,324 parts of an ethyl acetate solution of 65% low molecular polyester 1 was added and four passes by the bead mill under the above condition was given thereto to yield a pigment/wax dispersion 5. A solid content concentration of the pigment/wax dispersion 5 was 50%.

The composition obtained by adding 20 parts of inorganic particulates (Organosilica sol MEK-ST-UP with an ER of 20%, manufactured by Nissan Chemical Industries, Ltd.) to 100 parts of the above pigment/wax dispersion 5 and mixing by the TK homomixer at a rotational frequency of 7,000 rpm and a temperature of 25° C. for 10 minutes was rendered a pigment/wax/inorganic particulate dispersion 5. It is desirable to use the dispersion for emulsification within eight weeks from the preparation thereof. After this period, the inorganic particulates are aggregated again to make the shape control impossible.

Comparative Example 1

A toner was obtained in the same manner as Example 1 except that the conditions were changed as follows:

—Production of Oil Phase—

In a reaction vessel equipped with a stirring bar and a thermometer, 378 parts of the low molecular polyester 1, 100 parts of carnauba wax and 947 parts of ethyl acetate were placed, heated to 80° C. with stirring, maintained at 80° C. for five hours and subsequently cooled to 30° C. over one hour. Then, 500 parts of the master batch 1 and 500 parts of ethyl acetate were added to the vessel and mixed for one hours to yield the raw material solution 1.

Subsequently, 1,324 parts of the raw material solution 1 was transferred to a vessel, and carbon black and waxes were dispersed using the bead mill (Ultraviscomill, manufactured by IMEX Corporation) under the condition of a solution sending rate of 1 kg/hr, a disc peripheral speed of 6 m/sec., 0.5-mm zirconia beads packed at 80% by volume and one pass. Then, 1,324 parts of an ethyl acetate solution of 65% low molecular polyester 1 was added, and three passes by the bead mill under the above condition were given thereto to yield a pigment/wax dispersion 6. A solid content concentration of the pigment/wax dispersion 6 was 50%.

Comparative Example 2

A toner was obtained in the same manner as Example 1 except that the conditions were changed as follows:

Organic resin particulates on the toner surface were dissolved and removed as well as smoothed by inserting a process of an alkali (sodium hydroxide) treatment at a pH of 11 between the emulsification and the desolvation processes.

Comparative Example 3

Synthesis of Organic Particulate Emulsion

In a reaction vessel equipped with a stirring bar and a thermometer, 683 parts of water, 11 parts of sodium salt of methacrylic acid ethylene oxide adduct sulfate ester (Eleminol RS-30, manufactured by Sanyo Chemical Industries Ltd.), 83 parts of styrene, 83 parts of methacrylic acid, 110 parts of butyl acrylate and one part of ammonium persulfate were placed and stirred at 3,800 rpm for 30 minutes to obtain a creamy white emulsion. This was heated to 75° C. and reacted for four hours. Further, 30 parts of an aqueous solution of 1% ammonium persulfate was added, and the mixture was aged at 75° C. for six hours to yield an aqueous dispersion, particulate emulsion 2, of a vinyl based resin (copolymer of styrene-methacrylic acid-butyl acrylate-sodium salt of methacrylic acid ethylene oxide adduct sulfate ester). The particulate emulsion 2 was measured using a laser diffraction/scattering particle size distribution measurement apparatus (LA-920, manufactured by Horiba Seisakusho) to find that the volume average particle diameter was 110 nm. A resin content was isolated by drying a part of the particulate emulsion 2. The Tg and weight average molecular weight of the resin content were 58° C. and 130,000, respectively.

—Preparation of Aqueous Phase

A creamy white liquid was obtained by mixing and stirring 990 parts of water, 83 parts of particulate emulsion 2, 37 parts of an aqueous solution of 48.3% of sodium dodecyldiphenyletherdisulfonate (Eleminol MON-7, manufactured by Sanyo Chemical Industries Ltd.) and 90 parts of ethyl acetate. This is rendered the aqueous phase 1.

—Synthesis of Low Molecular Polyester—

In a reaction vessel equipped with a cooling tube, a stirrer and a nitrogen introducing tube, 724 parts of bisphenol A ethylene oxide 2 mole adduct and 276 parts of terephthalic acid were placed, for polycondensation at 230° C. under normal pressure for seven hours and further reacted under reduced pressure of 10 mmHg to 15 mmHg for five hours to yield the low molecular polyester 1. The low molecular polyester 1 exhibited a number average molecular weight of 2,300, a weight average molecular weight of 6,700, a peak molecular weight of 3,800, a glass transition temperature (Tg) of 43° C. and an acid value of four.

—Synthesis of Intermediate Polyester—

In a reaction vessel equipped with a cooling tube, a stirrer and a nitrogen introducing tube, 682 parts of bisphenol A ethylene oxide 2 mole adduct, 81 parts of bisphenol A propylene oxide 2 mole adduct, 283 parts of terephthalic acid, 22 parts of trimellitic acid anhydrate and 2 parts of dibutyltin oxide were placed, reacted at 230° C. under normal pressure for seven hours and further reacted under reduced pressure of 10 mmHg to 15 mmHg for five hours to yield an intermediate polyester 1.

The intermediate polyester 1 exhibited a number average molecular weight of 2,200, a weight average molecular weight of 9,700, a peak molecular weight of 3,000, a Tg of 54° C., an acid value of 0.5 and a hydroxyl value of 52.

Subsequently, in a reaction vessel equipped with a cooling tube, a stirrer and a nitrogen introducing tube, 410 parts of the intermediate polyester 1, 89 parts of isophorone diisocyanate and 500 parts of ethyl acetate were placed and reacted at 100° C. for five hours to yield a prepolymer 1. The mass fraction of the free isocyanate comprises in the prepolymer 1 was 1.53% by mass.

—Synthesis of Ketimine—

In a reaction vessel equipped with a stirring bar and a thermometer, 170 parts of isophorone diamine and 75 parts of methyl ethyl ketone were placed and reacted at 50° C. for 4.5 hours to yield the ketimine compound 1. The amine value of the ketimine compound 1 was 417.

—Synthesis of Master Batch—

A master batch 1 was obtained by placing 1,200 parts of water, 540 parts of carbon black (Printex 35, manufactured by Degussa AG with DBP oil absorption amount of 42 mL/100 mg and pH of 9.5) and 1,200 parts of a polyester resin, mixing using a Henschel mixer (Mitsui Mining Co., Ltd.). The mixture was kneaded using two rolls at 130° C. for one hour, which was then rolled, cooled and pulverized in a pulverizer.

—Production of Oil Phase—

In a reaction vessel equipped with a stirring bar and a thermometer, 378 parts of the low molecular polyester 1, 100 parts of carnauba wax and 947 parts of ethyl acetate were placed, heated to 80° C. with stirring, maintained at 80° C. for five hours, and subsequently cooled to 30° C. over one hour. Then, 500 parts of the master batch 1 and 500 parts of ethyl acetate were added into the vessel and mixed for one hour to yield the raw material solution 1.

Subsequently, 1,324 parts of the raw material solution 1 was transferred to a vessel, and carbon black and wax were dispersed using the bead mill (Ultraviscomill, manufactured by IMEX Corporation) under the condition of a solution sending rate of 1 kg/hr, a disc peripheral speed of 6 m/sec, 0.5-mm zirconia beads packed at 80% by volume and three passes. Then, 1,324 parts of an ethyl acetate solution of 65% low molecular polyester 1 was added and two passes by the bead mill under the above condition were given thereto to yield a pigment/wax dispersion 1. A solid content concentration of the pigment/wax dispersion 1 was 50%.

—Emulsification to Desolvation—

In a vessel, 749 parts of the pigment/wax/inorganic particulate emulsion 1, 115 parts of the prepolymer 1 and 2.9 parts of the ketimine compound 1 were placed and mixed using a TK homomixer (manufactured by Tokushu Kika Kogyo Co., Ltd.) at 5,000 rpm for two minutes Subsequently 1,200 parts of the aqueous phase 1 was added to the vessel and mixed using TK mixer at a rotational frequency of 13,000 rpm for 25 minutes to yield an emulsified slurry 1.

In a vessel equipped with a stirrer and a thermometer, the emulsified slurry 1 was placed for desolvation at 30° C. for seven hours, which was aged at 45° C. for seven hours to yield a dispersed slurry 1.

—Washing to Drying—

After 100 parts of the dispersed slurry 1 was filtrated under reduced pressure, the filtrate was washed as follows.

(i) One hundred (100) parts of ion-exchange water was added to the filter cake, mixed using the TK homomixer at a rotational frequency of 12,000 rpm for 10 minutes and subsequently filtered.

(ii) One hundred (100) parts of an aqueous solution of 10% sodium hydroxide was added to the filter cake of (i), mixed using the TK homomixer at a rotational frequency of 12,000 rpm for 10 minutes and subsequently filtered under reduced pressure.

(iii) One hundred (100) parts of 10% hydrochloric acid was added to the filter cake of (ii), mixed using the TK homomixer at a rotational frequency of 12,000 rpm for 10 minutes and subsequently filtered.

(iv) Three hundred (300) parts of ion-exchange water was added to the filter cake of (iii), mixed using the TK homomixer at a rotational frequency of 12,000 rpm for 10 minutes and subsequently filtered. These operations were repeated once to yield a filter cake 1.

The filter cake 1 was dried in a circular wind dryer at 45° C. for 48 hours and sieved with a mesh having 75 μm openings to yield toner base particles. Subsequently, one part of hydrophobic silica and one part of hydrophobic titanium oxide were mixed with 100 parts of the toner base particles 1 using the Henschel mixer to yield a toner.

Comparative Example 4

A toner was obtained in the same manner as Comparative Example 3 except that the conditions were changed as follows:

—Synthesis of Organic Particulate Emulsion—

In a reaction vessel equipped with a stirring bar and a thermometer, 683 parts of water, 11 parts of sodium salt of methacrylic acid ethylene oxide adduct sulfate ester (Eleminol RS-30, manufactured by Sanyo Chemical Industries Ltd.), 83 parts of styrene, 83 parts of methacrylic acid, 110 parts of butyl acrylate and one part of ammonium persulfate were placed and stirred at 3,800 rpm for 30 minutes to obtain a creamy white emulsion. This was heated to 75° C. and reacted for one hour. Further, 30 parts of an aqueous solution of 1% ammonium persulfate was added, and the mixture was aged at 75° C. for six hours to yield an aqueous dispersion (particulate emulsion 3) of a vinyl based resin (copolymer of styrene-methacrylic acid-butyl acrylate-sodium salt of methacrylic acid ethylene oxide adduct sulfate ester). The particulate emulsion 3 was measured using a particle size distribution measurement apparatus (LA-920, manufactured by Sysmex Corporation) to find that the volume average particle diameter was 40 nm. A resin content was isolated by drying a part of the particulate emulsion 3. The Tg and the weight average molecular weight of the resin content were 56° C. and 120,000, respectively.

Comparative Example 5

A toner was obtained in the same manner as Comparative Example 3 except that the conditions were changed as follows:

—Emulsification to Desolvation—

In a vessel, 749 parts of the pigment/wax/inorganic particulate dispersion 1, 115 parts of the prepolymer 1 and 2.9 parts of the ketimine compound 1 were placed and mixed using a TK homomixer (manufactured by Tokushu Kika Kogyo Co., Ltd.) at 5,000 rpm for two minutes. Subsequently, 1,200 parts of the aqueous phase 1 was added to the vessel and mixed using the TK homomixer at a rotational frequency of 13,000 rpm for 10 minutes to yield an emulsified slurry 2.

In a vessel equipped with a stirrer and a thermometer, the emulsified slurry 2 was added for desolvation at 30° C. for six hours, which was aged at 45° C. for five hours to yield a dispersed slurry 2.

Comparative Example 6

A toner was obtained in the same manner as Comparative Example 3 except that the conditions in the process of emulsification to desolvation were changed to the following:

—Emulsification to Desolvation—

In a vessel, 749 parts of the pigment/wax/inorganic particulate dispersion 1, 115 parts of the prepolymer 1 and 2.9 parts of the ketimine compound 1 were placed and mixed using a TK homomixer (manufactured by Tokushu Kika Kogyo Co., Ltd.) at 5,000 rpm for two minutes. Subsequently, 1,200 parts of the aqueous phase 1 was added to the vessel and mixed using the TK homomixer at a rotational frequency of 13,000 rpm for 40 minutes to yield an emulsified slurry 3.

In a vessel equipped with a stirrer and a thermometer, the emulsified slurry 3 was added for desolvation at 30° C. for eight hours, which was aged at 45° C. for five hours to yield a dispersed slurry 3.

Comparative Example 7

A toner was obtained in the same manner as Comparative Example 3 except that the conditions were changed as follows —Production of Oil Phase—

In a reaction vessel equipped with a stirring bar and a thermometer, 378 parts of the low molecular polyester 1, 130 parts of carnauba wax/rice wax (mass ratio of 5/5) and 947 parts of ethyl acetate were placed, heated to 80° C. with stirring maintained at 80° C. for four hours and subsequently cooled to 30° C. over one hour. Then, 500 parts of the master batch 1 and 500 parts of ethyl acetate were added to the vessel and mixed for two hours to yield a raw material solution 2.

Subsequently, 1,324 parts of the raw material solution 2 was transferred to a vessel, and carbon black and wax were dispersed using a bead mill (Ultraviscomill, manufactured by IMEX Corporation) under the condition of a solution sending rate of 1 kg/hr, a disc peripheral speed of 6 m/sec, 0.5-mm zirconia beads packed at 80% by volume and 10 passes. Then, 1,324 parts of an ethyl acetate solution of 65% low molecular polyester 1 was added and five passes by the bead mill under the above condition were given thereto to yield a pigment/wax dispersion 2. The concentration of the solid content of the pigment/wax dispersion 2 was 50%.

Comparative Example 8

A toner was obtained in the same manner as Comparative Example 3 except that the conditions were changed as follows.

—Production of Oil Phase—

In a reaction vessel equipped with a stirring bar and a thermometer, 378 parts of the low molecular polyester 1, 100 parts of carnauba wax/rice wax (mass ratio of 3/7) and 947 parts of ethyl acetate were placed, heated to 80° C. with stirring, maintained at 80° C. for four hours and subsequently cooled to 30° C. over one hour. Then, 500 parts of the master batch 1 and 500 parts of ethyl acetate were added to the vessel and mixed for 0.8 hours to yield a raw material solution 3.

Subsequently, 1,324 parts of the raw material solution 3 was transferred to a vessel, and carbon black and wax were dispersed using a bead mill (Ultraviscomill, manufactured by IMEX Corporation) under the condition of a solution sending rate of 1 kg/hr, a disc peripheral speed of 6 m/sec, 0.5-mm zirconia beads packed at 80% by volume and five passes. Then, 1,324 parts of an ethyl acetate solution of 65% low molecular polyester 1 was added, and three passes by the bead mill under the above condition was given thereto to yield a pigment/wax dispersion 3. The concentration of the solid content of the pigment/wax dispersion 3 was 50%.

Comparative Example 9

A toner was obtained in the same manner as Comparative Example 3 except that the conditions for the processes from the low molecular polyester, the emulsification to the desolvation were changed to the following.

—Synthesis of Low Molecular Polyester—

In a reaction vessel equipped with a cooling tube, a stirrer and a nitrogen introducing tube, 229 parts of bisphenol A ethylene oxide 2 mole adduct, 529 parts of bisphenylol A propylene oxide 3 mole adduct, 208 parts of terephthalic acid, 46 parts of adipic acid and two parts of dibutyltin oxide were placed, reacted at 230° C. under normal pressure for seven hours, and further reacted under reduced pressure of 10 mmHg to 15 mmHg for five hours. Subsequently, 44 parts of trimellitic acid anhydrate was added to the vessel, and reacted at 180° C. under normal pressure for three hours to yield a low molecular polyester 2. The low molecular polyester 2 exhibited a number average molecular weight of 2,300, a weight average molecular weight of 6,700, a peak molecular weight of 3,100, a Tg of 43° C. and an acid value of 25.

—Production of Oil Phase—

In a reaction vessel equipped with a stirring bar and a thermometer, 378 parts of the low molecular polyester 2, 100 parts of carnauba wax and 947 parts of ethyl acetate were placed, heated to 80° C. with stirring, maintained at 80° C. for five hours and subsequently cooled to 30° C. over one hour. Then, 500 parts of the master batch 1 and 500 parts of ethyl acetate were added to the vessel and mixed for one hour to yield a raw material solution 4.

Subsequently, 1,324 parts of the raw material solution 4 was transferred to a vessel, and carbon black and wax were dispersed using a bead mill (Ultraviscomill, manufactured by IMEX Corporation) under the condition of a solution sending rate of 1 kg/hr, a disc peripheral speed of 6 m/sec, 0.5-mm zirconia beads packed at 80% by volume and three passes. Then, 1,324 parts of an ethyl acetate solution of 65% low molecular polyester 2 was added, and three passes by the bead mill under the above condition was given thereto to yield a pigment/wax dispersion 4. The concentration of the solid content of the pigment/wax dispersion 4 was 50%.

—Emulsification to Desolvation—

In a vessel, 749 parts of the pigment/wax dispersion 4, 115 parts of the prepolymer 1 and 2.9 parts of the ketimine compound 1 were added and mixed using a TK homomixer (manufactured by Tokushu Kika Kogyo Co., Ltd.) at 5,000 rpm for two minutes. Subsequently, 1,200 parts of the aqueous phase 1 was added to the vessel and mixed using the TK homomixer at a rotational frequency of 13,000 rpm for 40 minutes to yield an emulsified slurry 4. In a vessel equipped with a stirrer and a thermometer, the emulsified slurry 4 was added for desolvation at 30° C. for eight hours, which was aged at 45° C. for five hours to yield a dispersed slurry 4.

Comparative Example 10

A toner was obtained in the same manner as Comparative Example 3 except that the conditions were changes as follows.

—Production of Oil Phase—

In a reaction vessel equipped with a stirring bar and a thermometer, 378 parts of the low molecular polyester 1, 380 parts of carnauba wax and 947 parts of ethyl acetate were placed, heated to 80° C. with stirring, maintained at 80° C. for four hours and subsequently cooled to 30° C. over one hour. Then, 500 parts of the master batch 1 and 500 parts of ethyl acetate were added to the vessel and mixed for two hours to yield a raw material solution 5.

Subsequently, 1,324 parts of the raw material solution 5 was transferred to a vessel, and carbon black and wax were dispersed using a bead mill (Ultraviscomill, manufactured by IMEX Corporation) under the condition of a solution sending rate of 1 kg/hr, a disc peripheral speed of 6 m/sec, 0.5-mm zirconia beads packed at 80% by volume and seven passes. Then, 1,324 parts of an ethyl acetate solution of 65% low molecular polyester 1 was added, and four passes by the bead mill under the above condition was given thereto to yield a pigment/wax dispersion 5. The concentration of the solid content of the pigment/wax dispersion 5 was 50%.

Comparative Example 11

A toner was obtained in the same manner as Comparative Example 3 except that the conditions were changed as follows.

Organic resin particulates on the toner surface were dissolved by inserting a process of an alkali (sodium hydroxide) treatment at a pH of 11 between the emulsification and the desolvation processes.

Comparative Example 12

A toner was obtained in the same manner as Comparative Example 3 except that the conditions were changed as follows.

—Synthesis of Low Molecular Polyester—

In a reaction vessel equipped with a cooling tube, a stirrer and a nitrogen introducing tube, 229 parts of bisphenol A ethylene oxide 2 mole adduct, 529 parts of bisphenol A propylene oxide 3 mole adduct, 208 parts of terephthalic acid, 46 parts of adipic acid and two parts of dibutyltin oxide were placed, reacted at 230° C. under normal pressure for seven hours and further reacted under reduced pressure of 10 mmHg 5 to 15 mmHg for five hours. Subsequently, 44 parts of trimellitic acid anhydrate was added to the vessel and reacted at 180° C. under normal pressure for three hours to yield a low molecular polyester 2. The low molecular polyester 2 exhibited a number average molecular weight of 2,300, a weight average molecular weight of 6,700, a peak molecular weight of 3,100, a Tg of 43° C. and an acid value of 25.

—Production of Oil Phase—

In a reaction vessel equipped with a stirring bar and a thermometer, 378 parts of the low molecular polyester 2, 100 parts of carnauba wax and 947 parts of ethyl acetate were placed, heated at 80° C. with stirring, maintained at 80° C. for five hours and subsequently cooled to 30° C. over one hour. Then, 500 parts of the master batch 1 and 500 parts of ethyl acetate were added to the vessel and mixed for one hour to yield a raw material solution 4.

Subsequently, 1,324 parts of the raw material solution 4 was transferred to a vessel, and carbon black and wax were dispersed using a bead mill (Ultraviscomill, manufactured by IMEX Corporation) under the condition of a solution sending rate of 1 kg/hr, a disc peripheral speed of 6 m/sec, 0.5-mm zirconia beads packed at 80% by volume and three passes. Then, 1,324 parts of an ethyl acetate solution of 65% low molecular polyester 2 was added, and two passes by the bead mill under the above condition was given thereto to yield a pigment/wax dispersion 4. The concentration of the solid content of the pigment/wax dispersion 4 was 50%.

—Emulsification to Desolvation—

In a vessel, 749 parts of the pigment/wax dispersion 4, 115 parts of the prepolymer 1 and 2.9 parts of the ketimine compound 1 were placed and mixed using a TK homomixer (manufactured by Tokushu Kika Kogyo Co., Ltd.) at 5,000 rpm for two minutes. Subsequently, 1,200 parts of the aqueous phase 1 was added to the vessel and left stand for one hour to yield an emulsified slurry 5.

In a vessel equipped with a stirrer and a thermometer, the emulsified slurry 5 was added for desolvation at 30° C. for eight hours to yield a dispersed slurry 5.

Comparative Example 13

First Step

—Preparation of Emulsion (1)—

| | |
|---|---|
| Styrene | 370 g |
| n-Butyl acrylate | 30 g |
| Acrylic acid | 8 g |
| Dodecane thiol | 24 g |
| Carbon tetrabromide | 4 g |

The above were mixed and dissolved. This was then dispersed and emulsified in a flask with 550 g of ion-exchange water in which 6 g of a nonionic surfactant (Nonipol 400, manufactured by Sanyo Chemical Industries Ltd.) and 10 g of an anionic surfactant (Neogen S C, manufactured by Dai-ichi Kogyo Seiyaku Co., Ltd.) had been dissolved. With slowly mixing for 10 minutes, 50 g of ion-exchange water in which 4 g of ammonium persulfate had been dissolved was added thereto. After nitrogen substitution, the content in the flask was heated to 70° C. in an oil bath with stirring, and emulsification polymerization was continued without any change for five hours. As a result, an emulsion (1) in which resin particles having an average particle diameter of 155 nm, a Tg of 59° C. and a weight average molecular weight of 12,000 were dispersed was prepared.

—Preparation of Emulsion (2)—

| | |
|---|---|
| Styrene | 280 g |
| n-Butyl acrylate | 120 g |
| Acrylic acid | 8 g |

The above had been mixed and dissolved. This was then dispersed and emulsified In a flask with 550 g of ion-exchange water in which 6 g of a nonionic surfactant (Nonipol 400, manufactured by Sanyo Chemical Industries Ltd.) and 12 g of an anionic surfactant (Neogen S C, manufactured by Dai-ichi Kogyo Seiyaku Co., Ltd.) had been dissolved. With slowly mixing for 10 minutes, 50 g of ion-exchange water in which 3 g of ammonium persulfate had been dissolved was added thereto. After nitrogen substitution, the content in the flask was heated to 70° C. in an oil bath with stirring, and emulsification polymerization was continued without any change for five hours to prepare an emulsion (2) in which resin particles having an average particle diameter of 105 nm, a Tg of 53° C. and a weight average molecular weight of 550,000 were dispersed.

—Preparation of Colorant Dispersion (1)—

| | |
|---|---|
| Carbon black (Morgal L, manufactured by Cabot Corporation) | 50 g |
| Nonionic surfactant (Nonipol 400 manufactured by Sanyo Chemical Industries Ltd.) | 5 g |
| Ion-exchange water | 200 g |

The above were mixed, dissolved and then dispersed for 10 minutes using a homogenizer (Ultratalax T50, manufactured by IKA) to prepare a colorant dispersion (1) in which a colorant (carbon black) having the average particle diameter of 250 nm was dispersed.

—Preparation of Releasing Agent Dispersion (1)—

| | |
|---|---|
| Paraffin wax (HNPO 190, melting point 85° C., manufactured by Nippon Seiro Co., Ltd.) | 50 g |
| Cationic surfactant (Sanisol B50 manufactured by Kao Corporation) | 7 g |
| Ion-exchange water | 200 g |

The above were heated to 95° C., dispersed using a homogenizer (Ultratalax T50, manufactured by IKA) and subsequently dispersed using a pressure discharge homogenizer to prepare a releasing agent dispersion (1) in which a releasing agent having the average particle diameter of 550 nm was dispersed.

Preparation of Agglomerated Particles

| | |
|---|---|
| Emulsion (1) | 120 g |
| Emulsion (2) | 80 g |
| Colorant dispersion (1) | 30 g |
| Releasing agent dispersion (1) | 40 g |
| Cationic surfactant (Sanisol B50, manufactured by Kao Corporation) | 1.5 g |

The above were mixed and dispersed in a round bottom flask made of stainless steel using a homogenizer (Ultratalax T50, manufactured by IKA), which was then heated to 48° C. in an oil bath for heating with stirring inside the flask. After maintaining at 48° C. for 30 minutes, it was confirmed that agglomerated particles with a volume of 95 $cm^3$ having an average particle diameter of about 5 μm had been formed when observed by optical microscope.

Second Step

—Preparation of Adhering Particles—

Thereto, 60 g of the emulsion (1) as a resin containing particulate emulsion was mildly added. The volume of the resin particles contained in the emulsion (1) was 25 $cm^3$. The temperature of the oil bath for heating was raised to 50° C. and maintained for one hour.

Third Step

Subsequently, 3 g of an anionic surfactant (Neogen S C, manufactured by Dai-ichi Kogyo Seiyaku Co., Ltd.) was added thereto. The stainless steal flask was sealed, heated to 105° C. with continuous stirring using a magnetic seal and maintained for three hours. A toner base was obtained by cooling, subsequently filtrating the reaction product, which was thoroughly washed with water and dried. Then, one part of hydrophobic silica and one part of hydrophobic titanium oxide were mixed with 100 parts of the toner base particles using the Henschel mixer to yield a toner.

Comparative Example 14

In a reactor equipped with a cooling tube, a stirrer and a nitrogen introducing tube, 724 parts of bisphenol A ethylene oxide 2 mole adduct, 276 parts of isophthalic acid and 2 parts of dibutyltin oxide were placed, reacted at 230° C. under normal pressure for eight hours, further reacted under reduced pressure of 10 mmHg to 15 mmHg for five hours and cooled to 160° C. Thereto, 32 parts of phthalic acid anhydrate was added and reacted for two hours. Next, this was cooled to 80° C. and reacted with 188 parts of isophorone diisocyanate in ethyl acetate for two hours to yield an isocyanate containing prepolymer 2. Then, 267 parts of the prepolymer 2 was reacted with 14 parts of isophorone diamine at 50° C. for two hours to yield an urea-modified polyester 1 having a weight average molecular weight of 64,000.

Similarly to the above, 724 parts of bisphenol A ethylene oxide 2 mole adduct, 138 parts of terephthalic acid and 138 parts of isophthalic acid were subjected to polycondensation at 230° C. under normal pressure for six hours and then reacted under reduced pressure of 10 mmHg to 15 mmHg for five hours to yield an unmodified polyester (a) having a peak molecular weight of 2,300, a hydroxyl value of 55 and an acid value of one.

Subsequently, 200 parts of the urea-modified polyester 1 and 800 parts of the unmodified polyester (a) were dissolved and mixed in 1,000 parts of a mixed solvent of ethyl acetate/MEK (1/1) to yield an ethyl acetate/MEK solution of a toner binder. In a reactor equipped with a cooling tube, a stirrer and a nitrogen introducing tube, 942 parts of water and 58 parts of 10% hydroxyapatite suspension (Supertite 10, manufactured by Nippon Chemical Industrial Co., Ltd.) was placed, and 1,000 parts of the ethyl acetate/MEK solution of the toner binder was added thereto and dispersed. The organic solvents were distilled off by raising the temperature to 98° C. followed by cooling. The product was separated from water by filtration, washed and dried to yield a toner binder 1. The toner binder 1 had a Tg of 52° C., Tη of 123° C. and TG' of 132° C.

Then, 100 parts of the toner binder 1, seven parts of glycerin tribehenate and four parts of cyanine blue (manufactured by Sanyo Color Works Ltd.) were incorporated into the toner by the following method. First, they were preliminarily mixed using a Henschel mixer (FM10B, manufactured by Mitsui Miike Kako K.K.) and subsequently kneaded by a biaxial kneader (PCM-30, manufactured by Ikegai Corporation). Then, they were finely pulverized using a supersonic jet pulverizer lab jet (manufactured by Nippon Pneumatic Mfg. Co., Ltd.) and classified by an airflow classifier (MDS-I, manufactured by Nippon Pneumatic Mfg. Co., Ltd.) to yield toner base particles. Subsequently, one part of hydrophobic silica and one part of hydrophobic titanium oxide were mixed with 100 parts of the toner base particles using the Henschel mixer to yield the toner.

Comparative Example 15

Production of Prepolymer

In a reactor equipped with a cooling tube, a stirrer and a nitrogen introducing tube, 724 parts of bisphenol A ethylene oxide 2 mole adduct, 276 parts of isophthalic acid and two parts of dibutyltin oxide were placed, reacted at 230° C. under normal pressure for eight hours, further reacted under reduced pressure of 10 mmHg to 15 mmHg for five hours with dehydrating and subsequently cooled to 160° C. Next, 74 parts of phthalic acid anhydrate was added thereto and reacted for two hours. Then, this was cooled to 80° C. and reacted with 174 parts of ethylene glycol diglycidyl ether in toluene for two hours to yield an epoxy group comprising prepolymer 3 having a weight average molecular weight of 13,000.

—Synthesis of Ketimine Compound—

In a reactor equipped with a stirring bar and a thermometer, 30 parts of isophorone diamine and 70 parts of MEK were added and reacted at 50° C. for five hours to yield a ketimine compound 2.

(Production of Dead Polymer)

Similarly to the above, 654 parts of bisphenol A ethylene oxide 2 mole adduct and 516 parts of terephthalate dimethyl ester were subjected to polycondensation at 230° C. under normal pressure for six hours and then reacted under reduced pressure of 10 mmHg to 15 mmHg for five hours with dehydration to yield a dead polymer 1 having a peak molecular weight of 2,400 and the hydroxyl value of two.

—Production of Toner—

In a beaker, 15.4 parts of the prepolymer 3, 64 parts of the dead polymer 1 and 78.6 parts of ethyl acetate were placed, stirred and dissolved. Then, 20 parts of pentaerythritol tetrabehenate and four parts of cyanine blue KRO (manufactured by Sanyo Color Works Ltd.) were added thereto and stirred at 60° C. using the TK type homogenizer at 12,000 rpm for uniform dissolution and dispersion. Finally, 2.7 parts of the ketimine compound 2 was added and dissolved. This is rendered a toner material solution (1).

In a beaker, 706 parts of ion-exchange water, 294 parts of 10% hydroxyapatite suspension (Supertite 10, manufactured by Nippon Chemical Industrial Co., Ltd.) and 0.2 parts of sodium dodecylbenzenesulfonate were added and uniformly dissolved. Then, the temperature was raised to 60° C. with stirring using the TK type homomixer at 12,000 rpm. The above toner material solution (1) was added thereto and stirred for 10 minutes. Then, this mixed solution was transferred to a kolven equipped with a stirring bar and a thermometer, and heated to 98° C. to remove the solvent via urea formation reaction. After filtrating, washing and drying, wind force classification was performed to yield toner base particles. Subsequently, one part of hydrophobic silica and one part of hydrophobic titanium oxide were mixed with 100 parts of the toner base particles using the Henschel mixer to yield a toner. The toner binder component had a weight average molecular weight of 14,000, a number average molecular weight of 2,000 and a Tg of 52° C.

Comparative Example 16

Method for Producing a Polymer

In a flask equipped with a stirrer, a condenser, a thermometer and a nitrogen introducing tube, 300 g of methanol, 100 g of toluene, 570 g of styrene, 30 g of 2-acrylamide-2-methylpropanesulfonic acid and 12 g of lauroyl peroxide were placed, which was subjected to solution-polymerization with stirring and under nitrogen introduction at 65° C. for 10 hours. The content was removed from the flask, dried under reduced pressure and subsequently pulverized by a jet mill to produce an A polymer having a weight average molecular weight of 3,000.

—Production of Toner—

| | |
|---|---|
| Styrene | 183 parts |
| 2-Ethylhexyl acrylate | 17 parts |
| The above A polymer | 0.1 parts |
| C.I. Pigment yellow 17 | 7 parts |

-continued

| | |
|---|---|
| Paraffin wax (with a melting point of 155° F., manufactured by Taisei Kosan K. K.) | 32 parts |
| Initiator (V-601, manufactured by Wako Pure Chemical Industries Ltd.) | 10 parts |

The above formulation was warmed up to 65° C. and uniformly dissolved or dispersed to make a monomer composition. Separately, 0.3 g of a silane coupling agent (KBE903, manufactured by Shin-Etsu Silicone) was uniformly dispersed in 1,200 mL of ion-exchange water, and 6 g of colloidal silica (Aerosil #200, manufactured by Nippon Aerosil Co., Ltd.) was added thereto and further uniformly dispersed. The pH of this dispersion was adjusted to six with hydrochloric acid to prepare a disperse medium system. The above monomer composition was added to this dispersing medium system and stirred at 70° C. under a nitrogen atmosphere using the TK homomixer at 6,500 rpm for 60 minutes to granulate the monomer composition. Subsequently, the granules were polymerized at 75° C. for eight hours with stirring by paddle stirring wings.

After the completion of the polymerization, a reaction product was cooled, treated with alkali overnight by adding 42 g of an aqueous solution of 20% sodium hydroxide. The dispersant was dissolved, filtrated, washed with water and dried to yield a toner.

The physical properties of the toner were evaluated as follows.

<Surface Characteristics>

ERA-8800FE, manufactured by Elionix Co., Ltd., was used as a field emission electron beam three dimensional roughness analyzer. The toner was measured with an acceleration voltage of 5 kV and no evaporation, and its surface characteristics were analyzed using an accessory software of the analyzer.

Platinum (Pt) and the like are evaporated in general for measurement in order to prevent charge-up due to electron beams when an organic substance is measured by an FE-SEM. However, there is a possibility that the original surface characteristics may not be observed because of the platinum evaporation. Therefore, the measurement was conducted without the evaporation for prevention of charge-up. The low acceleration voltage at 5 kV as well as a short duration of the electron-beam irradiation successfully prevented the charge-up.

Figure 6:
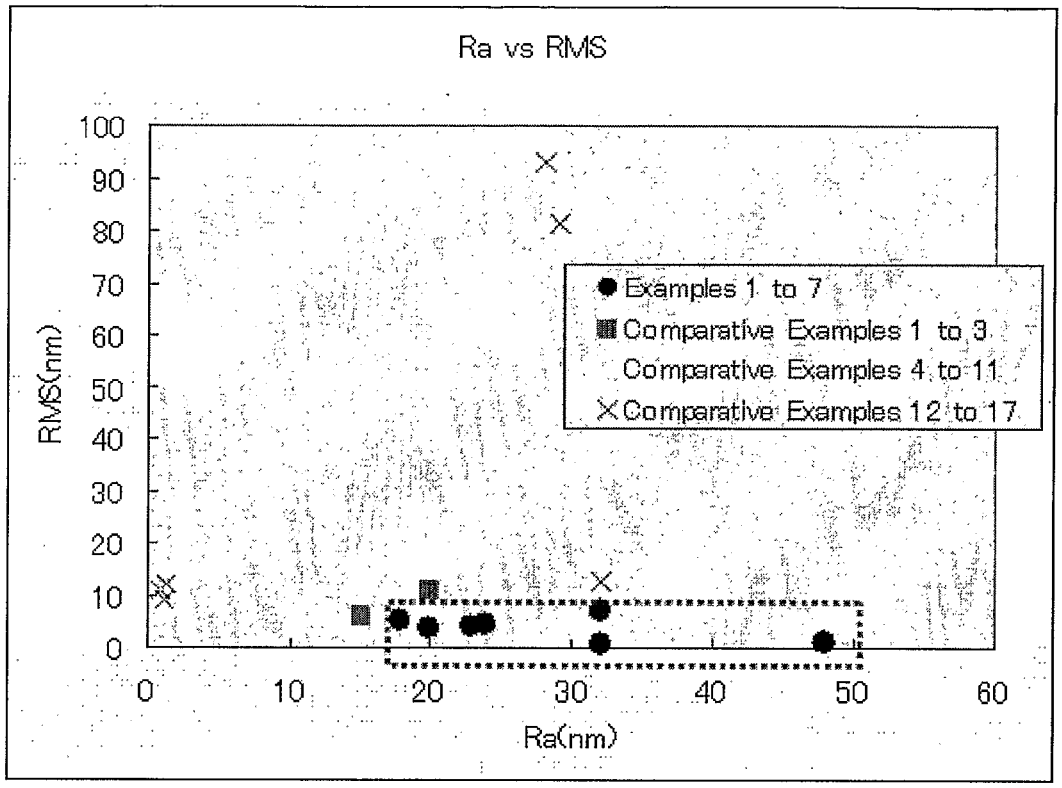
FIG. 6 is a diagram showing the relationship of a surface roughness (Ra) with a standard deviation (RMS) in toners of the present invention and conventional toners.

A relationship of the surface roughness (Ra) with its standard deviation (RMS) obtained in Examples and Comparative Examples is shown in FIG. 6. From this result, it is found that the standard deviation RMS is extremely small even when the surface roughness (Ra) is large in the toner of the present invention.

Figure 7:
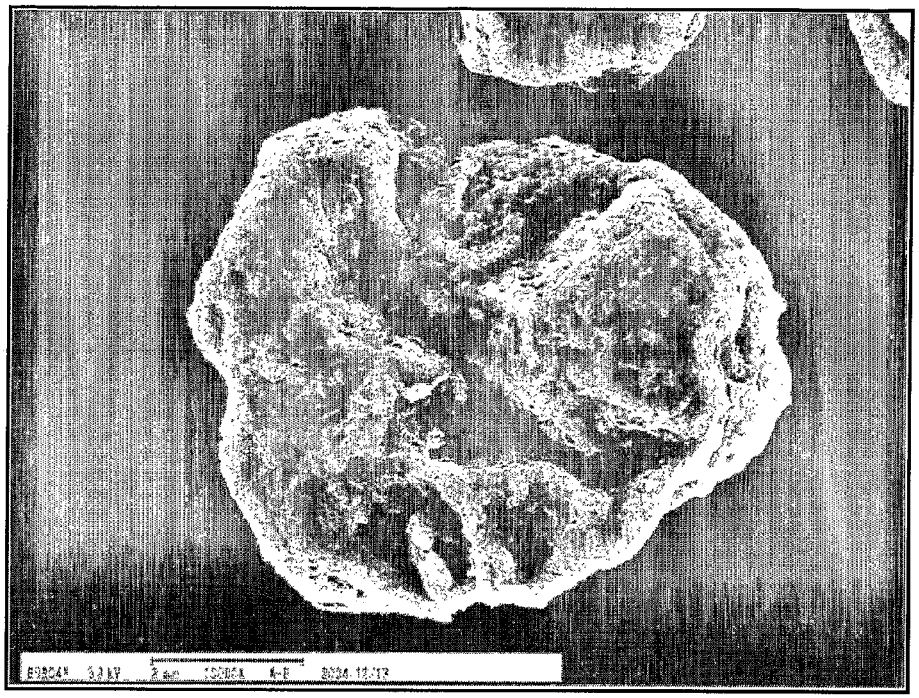
FIG. 7 is a view showing one example of an SEM photograph of a toner base particle in the toner of the present invention.
Figure 8:
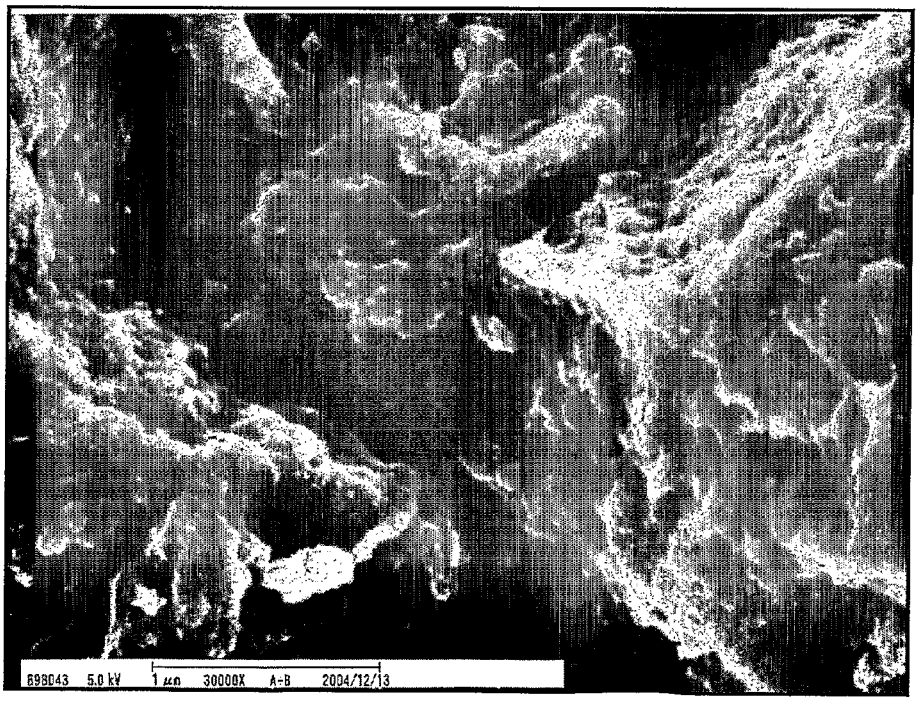
FIG. 8 is a view showing one example of a surface concavoconvex of a toner base particle in the toner of the present invention by 3D-SEM.
Figure 9:
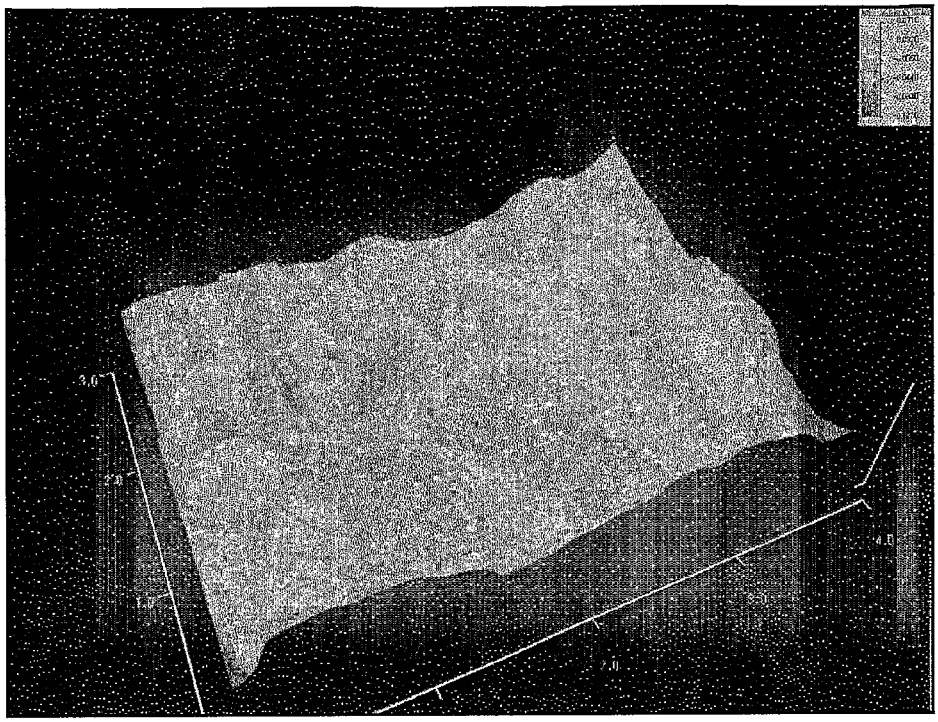
FIG. 9 is a view showing one example a surface concavoconvex of a toner base particle in the toner of the present invention by 3D-SEM as a topogram.
Figure 10:
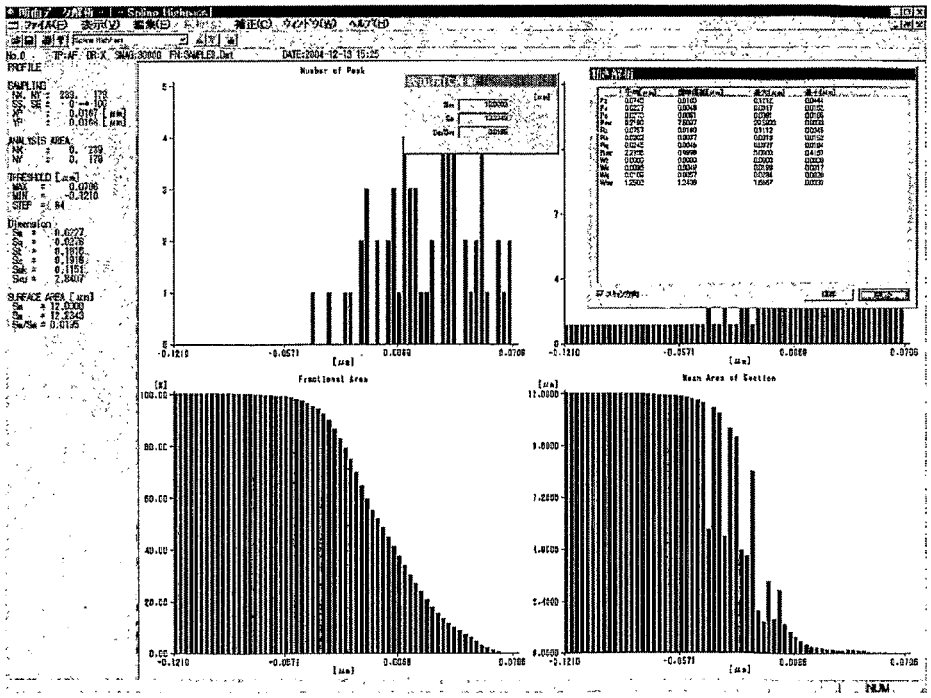
FIG. 10 is a collection of graphs showing one example of quantitative results of analyzing the roughness of toner base particles in the toner of the present invention.

FIG. 7 show an SEM photograph of the toner base particle of the toner in Example 1. FIGS. 8 and 9 show the surface concavoconvex by 3D-SEM of the toner base particles of the toner in Example 1. FIG. 10 shows the quantitative results of the above roughness analysis for such toner base particles. From these figures, it is understood that the toner surface is remarkably concavo-convex because the toner is produced by dissolution/dispersion of the toner material comprising an inorganic particulate using the organic solvent and granulation in the aqueous medium followed by desolvation.

<Circularity>

The measurement was performed using a flow type particle image analyzer (FPIA-2000, manufactured by Sysmex Corporation). In a given vessel, 100 mL to 150 mL of water in which solid impurities had been previously removed was placed, 0.1 mL to 0.5 mL of a surfactant was added as a dispersant, and further about 0.1 g to 9.5 g of a sample to be measured was added. A suspension in which the sample had been dispersed was dispersed for about one minute to three minutes using an ultrasonic distributor to make a dispersion concentration 3,000 particles/μL to 10,000 particles/μL, and the shape and the distribution of the toner were measured.

<Shape Coefficient>

A photograph of the toner was taken using a scanning electron microscope (S-4200, manufactured by Hitachi, Ltd.) and analyzed by an image analyzer (Luzex A P, manufactured by Nireco Corporation) for calculation.

<Average Particle Diameter and Particle Size Distribution>

A number distribution and a volume distribution were measured using Coulter Counter TA-II type (manufactured by Coulter), which was connected with an interface (manufactured by The Institute of Japanese Union of Scientists & Engineers) and PC9801 personal computer (manufactured by NEC Corporation) for output.

The toner was evaluated as follows.

<Cleaning Stability Over Time>

Using an evaluation machine obtained by rebuilding an image forming apparatus (IPSiO Color 8100, manufactured by Ricoh Company, Ltd.) to an oilless fixing mode and tuning, the stability of cleaning blades was examined after outputting 10,000 sheets of a chart with an image area fraction of 95%. The transferred toner left on the photoconductor which had passed the cleaning process was sampled on a white paper using a scotch tape (manufactured by Sumitomo Three M Co., Ltd.) and was measured using a Macbeth reflection densitometer, RD 514. The results were rated as follows:

A: discrepancy from a blank of less than 0.005
B: discrepancy of 0.005 to 0.010
C: discrepancy of 0.011 to 0.02
D: discrepancy of greater than 0.2

<Transfer Property>

Using the evaluation machine obtained by rebuilding the image forming apparatus (IPSiO Color 8100, manufactured by Ricoh Company, Ltd.) to the oilless fixing method and tuning, the transferred toner left on the photoconductor after a chart with an image area rate of 20% had been transferred onto a paper and just before the cleaning step was sampled onto a white paper using a scotch tape (manufactured by Sumitomo Three M Co., Ltd.) and was measured using a Macbeth reflection densitometer, RD 514. The results were rated as follows:

A: discrepancy from a blank of less than 0.005
B: discrepancy of 0.005 to 0.010
C: discrepancy of 0.011 to 0.02
D: discrepancy of greater than 0.2

<Charge Stability>

Using the evaluation machine obtained by rebuilding the image forming apparatus (IPSiO Color 8100, manufactured by Ricoh Company, Ltd.) to the oilless fixing method and tuning, an endurance test in which 100,000 sheets of a chart with an image area fraction of 5% were continuously output using each toner was carried out, and the change of charging amounts at that time was evaluated. Namely, 1 g of the developer was weighed, and the change of charge amounts was obtained by a blow off method. The results were rated as follows:

A: the change in the charge of 5 μc or less
B: the change of 10 μc or less
B: the change of 15 μc or less
C: the change of greater than 15 μc <Image Density>

Using the evaluation machine obtained by rebuilding the image forming apparatus (IPSiO Color 8100 manufactured by Ricoh Company, Ltd.) to the oilless fixing method and tuning, a solid image having an adhered amount of 0.4±0.1 mg/cm$^2$ was output onto a transfer paper of a plain paper (Type 6200, manufactured by Ricoh Company, Ltd.), and subsequently the image density was measured by X-Rite (manufactured by X-Rite). The image densities of 1.4 or more was marked as 'OK'; 'NG', otherwise.

<Image Graininess and Sharpness>

Using the evaluation machine obtained by rebuilding the image forming apparatus (IPSiO Color 8100, manufactured by Ricoh Company, Ltd.) to the oilless fixing method and tuning, a photograph image with single color was output, and levels of graininess and sharpness were visually evaluated. They were evaluated as A, B, C and D sequentially from the excellent level as follows:

A: offset printing level
B: slightly inferior to the offset printing level
C: considerably inferior to the offset printing level
D: conventional electrographic level and very inferior <Fog>

In an environment with a temperature of 10° C. and a relative humidity of 15%, using the evaluation machine obtained by rebuilding the image forming apparatus (IPSiO Color 8100, manufactured by Ricoh Company, Ltd.) to the oilless fixing method and tuning, an endurance test in which 100,000 sheets of a chart with an image area rate of 5% were continuously output was carried out using each toner, and subsequently a stain level with the toner on the surface of the transfer paper was visually (loupe) evaluated. They were evaluated as A, B, C and D sequentially from the excellent level as follows:

A: excellent with no toner stain observed
B: favorable with little toner stain observed
C: fair with some toner stain observed
D: poor with severe toner stain, not acceptable <Toner Scattering>

In an environment with a temperature of 40° C. and a relative humidity of 90%, using the evaluation machine obtained by rebuilding the image forming apparatus (IPSiO Color 8100, manufactured by Ricoh Company, Ltd.) to the oilless fixing method and tuning, an endurance test in which 100,000 sheets of the chart with an image area rate of 5% were continuously output using each toner and was carried out, and subsequently a contaminated state with the toner in the copying machine was visually evaluated as follows:

A: excellent with no toner stain observed
B: favorable with little toner stain observed
C: fair with some toner stain observed
D: poor with severe toner stain, not acceptable <Environmental Storage Stability (Blocking Resistance)>

A penetration was measured by a penetrometer after 10 g of the toner was weighed, placed in a 20 mL glass vessel, which was then tapped 100 times and subsequently left stand in an incubator set at temperature of 55° C. and a relative humidity of 80% for 24 hours. The penetration was also evaluated for the toner stored at a low temperature of 10° C. and a low relative humidity 15%. In either environment with high temperature and high humidity or with low temperature and low humidity, a lower value of the penetration was accepted and evaluated as follows from the superior:

A: 20 mm or more
B: 15 mm or more and less than 20 mm
C: 10 mm or more and less than 15 mm
D: less than 10 mm.

The physical properties and evaluation results of the toners obtained in the above Examples and Comparative Examples are shown in Table 1 and 2, respectively.

TABLE 1

| Physical Property Values | | | | | | | | | | |
|---|---|---|---|---|---|---|---|---|---|---|
| | Backside State | | | Circularity | Shape | | | | | |
| | Ra | RMS | Rz | Average | Coefficient | | Particle Diameter | | | |
| Comparative | (nm) | (nm) | (nm) | Circularity | SF-2 | Ra/SF-2 | Dv* | Dn* | Dv/Dn | Ra/Dv |
| Example 1 | 20 | 3.7 | 78 | 0.94 | 135 | 0.15 | 5.5 | 5.1 | 1.08 | 3.6 |
| Example 2 | 32 | 7.1 | 110 | 0.93 | 138 | 0.23 | 5.6 | 5.1 | 1.12 | 5.7 |
| Example 3 | 48 | 1.2 | 130 | 0.97 | 127 | 0.38 | 3.1 | 2.5 | 1.24 | 15.5 |
| Example 4 | 18 | 5.2 | 51 | 0.93 | 126 | 0.14 | 5.9 | 5.2 | 1.13 | 3.1 |
| Example 5 | 24 | 4.6 | 105 | 0.92 | 138 | 0.17 | 5.4 | 4.5 | 1.20 | 4.4 |
| Example 6 | 23 | 4.1 | 110 | 0.98 | 118 | 0.19 | 6.5 | 5.1 | 1.27 | 3.5 |
| Example 7 | 32 | 0.9 | 140 | 0.94 | 142 | 0.23 | 5.9 | 5.4 | 1.09 | 5.4 |
| Comparative Example 1 | 15 | 6.2 | 47 | 0.98 | 118 | 0.13 | 5.5 | 4.8 | 1.15 | 2.7 |
| Comparative Example 2 | 20 | 11.0 | 26 | 0.96 | 122 | 0.16 | 5.2 | 4.4 | 1.18 | 3.8 |
| Comparative Example 3 | 20 | 50 | 29 | 0.97 | 120 | 0.17 | 5.1 | 3.8 | 1.34 | 3.9 |
| Comparative Example 4 | 1.5 | 15 | 15 | 0.96 | 115 | 0.01 | 4.8 | 4.2 | 1.14 | 0.3 |
| Comparative Example 5 | 28 | 21 | 35 | 0.98 | 135 | 0.21 | 2.4 | 2.1 | 1.14 | 1.7 |
| Comparative Example 6 | 17 | 83 | 21 | 0.93 | 127 | 0.13 | 5.9 | 5.2 | 1.13 | 2.9 |
| Comparative Example 7 | 24 | 46 | 28 | 0.92 | 139 | 0.17 | 5.5 | 4.5 | 1.22 | 4.4 |
| Comparative Example 8 | 18 | 75 | 26 | 0.93 | 138 | 0.13 | 5.7 | 3.9 | 1.46 | 3.2 |
| Comparative Example 9 | 23 | 81 | 29 | 0.97 | 118 | 0.19 | 6.2 | 5.1 | 1.22 | 3.7 |
| Comparative Example 10 | 3 | 24 | 19 | 0.94 | 141 | 0.02 | 6.7 | 5.4 | 1.24 | 0.4 |
| Comparative Example 11 | 0.8 | 11 | 18 | 0.97 | 122 | 0.01 | 5 | 4.4 | 1.14 | 0.2 |
| Comparative Example 12 | 22 | 13 | 49 | 0.95 | 138 | 0.23 | 4.3 | 3.7 | 1.16 | 7.4 |
| Comparative Example 13 | 1.1 | 9 | 18 | 0.96 | 118 | 0.01 | 5.2 | 4.2 | 1.24 | 0.2 |
| Comparative Example 14 | 28 | 93 | 20 | 0.94 | 139 | 0.20 | 3.2 | 2.8 | 1.14 | 8.8 |
| Comparative Example 15 | 1.2 | 12 | 21 | 0.95 | 120 | 0.01 | 5.3 | 4.7 | 1.13 | 0.2 |
| Comparative Example 16 | 29 | 81 | 32 | 0.96 | 123 | 0.24 | 4.1 | 3.5 | 1.17 | 7.1 |

TABLE 2

| Evaluation results | | | | | | | | |
|---|---|---|---|---|---|---|---|---|
| | Cleaning Stability With Time | Transfer Property | Charging Stability | Image Density | Image Graininess Sharpness | Fog | Toner Scattering | Environmental Storage Stability |
| Example 1 | B | B | B | OK | B | B | B | B |
| Example 2 | A | B | C | OK | B | B | C | B |
| Example 3 | C | C | B | OK | A | B | C | B |
| Example 4 | B | A | B | OK | B | B | B | A |
| Example 5 | A | C | B | OK | C | C | C | B |
| Example 6 | A | A | C | OK | C | B | B | B |
| Example 7 | B | C | C | OK | C | C | C | C |
| Comparative Example 1 | D | B | C | OK | B | C | B | C |
| Comparative Example 2 | D | D | D | NG | B | D | D | D |
| Comparative Example 3 | D | B | B | OK | B | B | B | B |
| Comparative Example 4 | D | A | C | OK | B | C | B | C |
| Comparative Example 5 | D | C | A | OK | C | B | A | A |
| Comparative Example 6 | D | C | A | OK | B | A | B | B |
| Comparative Example 7 | D | B | B | OK | C | B | B | A |
| Comparative Example 8 | D | A | B | OK | C | C | B | A |
| Comparative Example 9 | D | B | C | OK | C | A | B | C |
| Comparative Example 10 | D | B | B | OK | C | B | C | A |
| Comparative Example 11 | D | B | D | OK | B | C | D | D |
| Comparative Example 12 | C | D | B | NG | C | D | C | B |
| Comparative Example 13 | C | B | D | OK | B | D | C | D |
| Comparative Example 14 | A | D | B | NG | C | D | C | D |
| Comparative Example 15 | D | C | D | NG | D | D | D | D |
| Comparative Example 16 | B | D | D | NG | C | D | D | D |

Tables 1 and 2 indicate that a toner having the surface characteristics defined in the present invention has excellent charge property, developing property and transfer property. It is also possible to make the toner superior in terms of cleaning stability over time and environmental storage stability without fog and toner scattering by controlling the circularity, the shape coefficient and the particle diameter.

The invention claimed is:

1. A toner comprising:

toner base particles, which comprise a binder resin and a colorant, wherein the toner base particles have a surface roughness (Ra) of 18 nm to 50 nm and a standard deviation (RMS) of the surface roughness of 0.9 nm to 9.9 nm, wherein inorganic particulates are comprised inside of the toner base particles, wherein the toner is obtained by granulation of a solution or a dispersion in which a toner material comprising inorganic particulates is dissolved or dispersed in an organic solvent in an aqueous medium followed by removal of the organic solvent, wherein the inorganic particulates are organosilica sols, and wherein a percentage of the inorganic particulates is 0.01% to 5% by mass in the toner.

2. The toner according to claim 1, wherein the surface roughness (Rz) of the toner base particles is 30 nm to 140 nm.

3. The toner according to claim 1, wherein the average circularity of the toner base particles is 0.93 to 0.98.

4. The toner according to claim 1, wherein the volume average particle diameter (Dv) of the toner base particles is 2.0 μm to 6.0 μm, and the ratio of the volume average particle diameter (Dv) to the number average particle diameter (Dn), Dv/Dn, is 1.08 to 1.40.

5. The toner according to claim 4, wherein the ratio of the surface roughness (Ra) to the volume average particle diameter (Dv), Ra (nm)/Dv (μm), is 0.3 to 15.5.

6. The toner according to claim 1, wherein the toner base particle has a shape factor SF-2 represented by the Formula III below of 100 to 140 and the ratio of the surface roughness (Ra) to the shape factor (SF-2), Ra/SF-2, of 0.01 to 0.38:

$$SF-2=\frac{(PERI)^2}{\text{AREA}}\times\frac{\pi}{4}\times 100 \qquad \text{Formula III}$$

wherein PERI represents the circumferential length of the shape obtained by projecting the toner base particle to a two dimensional plane, and AREA represents the area of a shape obtained by projecting the toner base particle to a two dimensional plane.

7. The toner according to claim 1, wherein the toner base particles comprise a resin which is different from the binder resin on the surface of the toner base particles.

8. The toner according to claim 1, wherein the toner base particles comprise a releasing agent in the toner base particles.

9. The toner according to claim 1, wherein the toner is obtained by dissolution or dispersion of a toner material which comprises a polyester prepolymer with a functional group comprising a nitrogen atom, a polyester resin, a colorant and a releasing agent in an organic solvent, followed by dispersion of the solution or the dispersion in an aqueous medium for any one of a crosslinking reaction and an extending reaction.

10. A developer comprising:

a toner which comprises toner base particles, which comprise a binder resin and a colorant, wherein the toner base particles have a surface roughness (Ra) of 18 nm to 50 nm and a standard deviation (RMS) of the surface roughness of 0.9 nm to 9.9 nm, wherein inorganic particulates are comprised inside of the toner base particles, wherein the toner is obtained by granulation of a solution or a dispersion in which a toner material comprising inorganic particulates is dissolved or dispersed in an organic solvent in an aqueous medium followed by removal of the organic solvent, wherein the inorganic particulates are organosilica sols, and wherein a percentage of the inorganic particulates is 0.01% to 5% by mass in the toner.

11. The developer according to claim 10, wherein the developer is any one of a one-component developer and a two-component developer.

12. A developing apparatus, wherein a developer is borne and delivered by a latent image bearing member, and an alternating electric field is applied at a position opposite to the latent image bearing member to develop a latent electrostatic image on the latent image bearing member, wherein the developer comprises a toner comprising toner base particles, which comprise a binder resin and a colorant, wherein the toner base particles have a surface roughness (Ra) of 18 nm to 50 nm and a standard deviation (RMS) of the surface roughness of 0.9 nm to 9.9 nm, wherein inorganic particulates are comprised inside of the toner base particles, wherein the toner is obtained by granulation of a solution or a dispersion in which a toner material comprising inorganic particulates is dissolved or dispersed in an organic solvent in an aqueous medium followed by removal of the organic solvent, wherein the inorganic particulates are organosilica sols, and wherein a percentage of the inorganic particulates is 0.01% to 5% by mass in the toner.

13. The toner according to claim 1, wherein Ra is from 18 nm to 30 nm.

14. The toner according to claim 1, wherein the RMS is from 2 nm to 8 nm.

15. The toner according to claim 13, wherein the RMS is from 2 nm to 8 nm.

* * * * *